US009692166B2

(12) United States Patent
Kao et al.

(10) Patent No.: US 9,692,166 B2
(45) Date of Patent: Jun. 27, 2017

(54) ELECTRICAL RECEPTACLE CONNECTOR AND ELECTRICAL PLUG CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Wen-Yu Wang, New Taipei (TW); Wen-Hsien Tsai, New Taipei (TW); Chung-Fu Liao, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/719,878

(22) Filed: May 22, 2015

(65) Prior Publication Data

US 2015/0340791 A1 Nov. 26, 2015

(30) Foreign Application Priority Data

May 22, 2014 (TW) ..... 103208994 U
Nov. 11, 2014 (TW) ..... 103139131 A

(51) Int. Cl.
*H01R 24/00* (2011.01)
*H01R 13/42* (2006.01)
(Continued)

(52) U.S. Cl.
CPC ..... *H01R 13/42* (2013.01); *H01R 13/6474* (2013.01); *H01R 24/60* (2013.01); *H01R 2107/00* (2013.01)

(58) Field of Classification Search
CPC ..... H01R 24/60; H01R 23/02; H01R 24/62; H01R 13/648
(Continued)

(56) References Cited

U.S. PATENT DOCUMENTS 5,256,502 A * 10/1993 Kump ..... H01M 2/1005 429/150
6,379,184 B1 * 4/2002 Bassler ..... H01R 13/6625 439/607.27
(Continued)

FOREIGN PATENT DOCUMENTS

CN 203481453 U 3/2014
TW M403785 U 5/2011
(Continued)

*Primary Examiner* — Abdullah Riyami
*Assistant Examiner* — Nader Alhawamdeh

(57) ABSTRACT

An electrical receptacle connector is disclosed. The electrical receptacle connector includes a plurality of upper-row receptacle terminals and lower-row receptacle terminals. The plurality of upper-row receptacle terminals and lower-row receptacle terminals have 180 degree symmetrical, dual or double orientation design which enable the electrical plug connector to be inserted into the electrical receptacle connector in either of two intuitive orientations. Each of the receptacle terminals includes a flat contact portion, a soldering portion and a connecting portion. The flat contact portion is extended from one end of the connecting portion, and the soldering portion is extended from the other end of the connecting portion. The width of the connecting portion is different from the width of the flat contact portion.

17 Claims, 20 Drawing Sheets

(51) Int. Cl.
*H01R 24/60* (2011.01)
*H01R 13/6474* (2011.01)
*H01R 107/00* (2006.01)

(58) Field of Classification Search
USPC ..... 439/660, 626, 607.28
See application file for complete search history.

(56) References Cited

U.S. PATENT DOCUMENTS 7,611,387 B1 * 11/2009 Zhang ..... H01R 12/725 439/660
7,862,346 B1 * 1/2011 Wan ..... H01R 12/712 439/607.04
7,909,653 B1 * 3/2011 Wan ..... H01R 13/514 439/660
8,398,438 B2 * 3/2013 Zhang ..... H01R 13/6471 439/660
8,814,583 B2 * 8/2014 Naito ..... H01R 24/60 439/188
9,178,319 B2 * 11/2015 Little ..... H01R 13/6585
9,214,766 B1 * 12/2015 Yu ..... H01R 13/6585
2005/0186843 A1 * 8/2005 Tsai ..... H01R 23/6873 439/607.36
2005/0221656 A1 * 10/2005 Haga ..... H01R 13/65802 439/352
2009/0042450 A1 * 2/2009 Zheng ..... H01R 23/6873 439/660
2011/0151716 A1 * 6/2011 Kondo ..... H01R 13/6658 439/607.01
2013/0059472 A1 * 3/2013 Saito ..... H01R 13/648 439/607.27
2014/0065889 A1 * 3/2014 Zhang ..... H01R 43/24 439/660
2015/0111427 A1 * 4/2015 Wu ..... H01R 13/2457 439/607.01
2015/0255925 A1 * 9/2015 Katayanagi ..... H01R 24/76 439/108
2015/0380884 A1 * 12/2015 Lee ..... H01R 24/60 439/676

FOREIGN PATENT DOCUMENTS

TW 201330405 A 7/2013
TW M472996 U 2/2014

* cited by examiner

100

| | | | | | | | | | | | |
|---|---|---|---|---|---|---|---|---|---|---|---|
| GND | TX1+ | TX1− | VBUS | CC1 | D+ | D− | RFU | VBUS | RX2− | RX2+ | GND |
| GND | RX1+ | RX1− | VBUS | RFU | D− | D+ | CC2 | VBUS | TX2− | TX2+ | GND |

131

132

FIG. 4B

| | | | | | | | | | | | |
|---|---|---|---|---|---|---|---|---|---|---|---|
| GND | RX2+ | RX2− | VBUS | RFU | D− | D+ | CC1 | VBUS | TX1− | TX1+ | GND |
| GND | TX2+ | TX2− | VBUS | CC2 | D+ | D− | RFU | VBUS | RX1− | RX1+ | GND |

231
232

FIG. 8B

ELECTRICAL RECEPTACLE CONNECTOR AND ELECTRICAL PLUG CONNECTOR

CROSS-REFERENCES TO RELATED APPLICATIONS

This non-provisional application claims priority under 35 U.S.C. §119(a) on Patent Application No. 103208994 and 103139131, filed in Taiwan, R.O.C. on May 22, 2014 and Nov. 11, 2014, the entire contents of which are hereby incorporated by reference.

FIELD OF THE INVENTION

The instant disclosure relates to an electrical connector, and more particularly to an electrical receptacle connector and an electrical plug connector corresponding to the electrical receptacle connector.

BACKGROUND

Nowadays, all kinds of electronic products become more versatile, and provide unlimited convenience and high handiness. Specifications of the transmission interfaces of the electrical connectors of conventional electronic devices are quite diverse, for example, by taking a universal serial bus (USB) as an example, the USB 2.0 transmission specification has been developed to the present USB 3.0 transmission specification at a faster transmission speed, and USB transmission interfaces have gradually been used by the public.

Please refer to FIGS. 1A and 1B. FIG. 1A is a perspective view of a plurality of conventional terminals, and FIG. 1B is a schematic view of a high-frequency test curve for the conventional terminals. A conventional USB electrical receptacle connector has a plurality of conventional terminals A for transmitting signals, the conventional terminals A are bonded to a rubber core body, and what affects high-frequency characteristics of the conventional USB electrical receptacle connector is the permittivity of components of the conventional USB electrical receptacle connector and other factors.

The existing electrical plug connectors and electrical receptacle connectors all include the conventional terminals A, and the conventional terminals A includes a plurality of front-end contact areas A1, a plurality of connection areas A2, and a plurality of backend soldering areas A3 connected sequentially. Signal transmission is performed by the mutual contact between the front-end contact areas A1 of the electrical plug connectors and the electrical receptacle connectors. However, the width of each of the connection areas A2 of the conventional terminals A is equal to the width of the corresponding front-end contact area A1. During high-frequency test, the impedance of the conventional terminals A is below 75 ohm, which means the value is below the standard specification, as indicated by the lower dot line shown in FIG. 1B. When the conventional terminals A of the electrical plug connectors and the electrical receptacle connectors transmit signals, the quality of the signals transmitted and the high-frequency characteristics are affected due to the impedance of the conventional terminals is lower than 75 ohm. Therefore, it is therefore necessary to establish and develop a new architecture of USB connectors to address the previously mentioned needs of platforms and devices, while retaining all of the functional benefits of USB that form the basis for this most popular of computing device interconnects.

SUMMARY OF THE INVENTION

In view of the above problem, one embodiment of the instant disclosure provides an electrical receptacle connector comprising a metallic shell, an insulated housing, a plurality of upper-row receptacle terminals and a plurality of lower-row receptacle terminals. The metallic shell defines a receptacle cavity. The insulated housing is received in the receptacle cavity. The insulated housing comprises a base portion and a tongue portion. The tongue portion is extended from one side of the base portion and defines an upper surface and a lower surface which are the opposite surfaces of the tongue portion. The upper-row receptacle terminals comprise a plurality of upper-row signal terminals, at least one upper-row power terminal, and at least one upper-row ground terminal. Each of the upper-row receptacle terminals is held in the base portion, arranged in the tongue portion, and disposed at the upper surface of the tongue portion. The lower-row receptacle terminals comprise a plurality of lower-row signal terminals, at least one lower-row power terminal, and at least one lower-row ground terminal. Each of the lower-row receptacle terminals is held in the base portion, arranged in the tongue portion, and disposed at the lower surface of the tongue portion. Each of the receptacle terminals defines a flat contact portion, a soldering portion, and a connecting portion. The flat contact portion is arranged in the tongue portion and disposed the corresponding surface of the tongue, the soldering portion is exposed out of the base portion, and the connecting portion is held in the insulated housing. The flat contact portion is extended from one of two ends of the connecting portion and the soldering portion is extended from the other end of the connecting portion. The width of the connecting portion is different from the width of the flat contact portion.

The instant disclosure also provides an electrical plug connector, one embodiment of the electrical plug connector comprises a metallic shell, an insulated housing, a plurality of upper-row plug terminals and a plurality of lower-row plug terminals. The metallic shell defines a plug cavity. The insulated housing is received in the plug cavity. The insulated housing comprises an upper portion and a lower portion and defines an insertion cavity between the upper portion and the lower portion. The upper-row plug terminals comprise a plurality of upper-row signal terminals, at least one upper-row power terminal and at least one upper-row ground terminal. Each of the upper-row plug terminals is held in the upper portion of the insulated housing and disposed at a lower surface of the upper portion. The lower-row plug terminals comprise a plurality of lower-row signal terminals, at least one lower-row power terminal and at least one lower-row ground terminal. Each of the lower-row plug terminals is held in the lower portion of the insulated housing and disposed at an upper surface of the lower portion. Each of the plug terminals comprises an elastic contact portion, a soldering portion and a connecting portion. The elastic contact portion projects into the insertion cavity. The soldering portion is exposed out of the insulated housing. The connecting portion is held in the insulated housing. The elastic contact portion is extended from one of two ends of the connecting portion and the soldering portion is extended form the other end of the connecting portion. The width of the connecting portion is different from the width of the elastic contact portion.

As mentioned above, the width of the connecting portion of each flat signal terminal is different from the width of the corresponding flat contact portion such that the impedance of the flat signal terminals can be adjusted within a specific range, and the impedance curve or the impedance profile of the flat signal terminals of the electrical receptacle connector is smoother than conventional and is not beyond the specific range so as to perform good high-frequency characteristics. Moreover, because plastic has a higher dielectric constant than air, the region of at least one portion of the insulated housing corresponding to the terminal slots of the electrical receptacle connector for receiving the receptacle terminals further forms a groove or a through hole to expose the terminals to air so as to affect the impedance of terminals for USB 3.0 signal transmission. In other words, the region of at least one portion of the insulated housing corresponding to the terminal slots for receiving the receptacle terminals forms a groove or a through hole to expose the terminals to air so as to adjust the impedance of terminals for USB 3.0 signal transmission. Accordingly, the region of at least one portion of the insulated housing corresponding to the terminal slots for receiving the receptacle terminals forms a groove or a through hole to expose the terminals to air so as to change the impedance of terminals for USB 3.0 signal transmission and perform good high-frequency characteristics. In addition, a plurality of recessed portions formed in a front end of a grounding plate corresponding to the flat contact portions of terminals adjust the impedance of the signal terminals in order to perform good high-frequency characteristics.

Furthermore, the width of the connecting portion of each plug terminal is different from the width of the corresponding elastic contact portion such that the impedance of the elastic signal terminals can be adjusted within the specific range, and the impedance profile or the impedance curve of the elastic signal terminals of the electrical plug connector is smoother than conventional and is not beyond the specific range so as to perform good high-frequency characteristics. Moreover, because plastic has a higher dielectric constant than air, the region of at least one portion of the insulated housing corresponding to the terminal slots of the electrical plug connector for receiving terminals further forms a groove or a through hole to expose the terminals to air so as to affect the impedance of terminals for USB 3.0 signal transmission. In other words, the region of at least one portion of the insulated housing corresponding to the terminal slots for receiving the plug terminals forms a groove or a through hole to expose the terminals to air so as to adjust the impedance of terminals for USB 3.0 signal transmission. Accordingly, the region of at least one portion of the insulated housing corresponding to the terminal slots for receiving the plug terminals forms a groove or a through hole to expose the terminals to air so as to change the impedance of terminals for USB 3.0 signal transmission and perform good high-frequency characteristics.

Detailed description of the characteristics and the advantages of the instant disclosure is shown in the following embodiments, the technical content and the implementation of the instant disclosure should be readily apparent to any person skilled in the art from the detailed description, and the purposes and the advantages of the instant disclosure should be readily understood by any person skilled in the art with reference to content, claims and drawings in the disclosure.

BRIEF DESCRIPTION OF THE DRAWINGS

The disclosure will become more fully understood from the detailed description given herein below for illustration only, and thus are not limitative of the disclosure, and wherein:

FIG. 4B is a schematic configuration diagram of the pin arrangement of the receptacle terminals of the electrical receptacle connector according to the instant disclosure;

FIG. 8B is a schematic configuration diagram of the pin arrangement of a plurality of plug terminals of the electrical plug connector according to the instant disclosure;

DETAILED DESCRIPTION

Figure 2A:
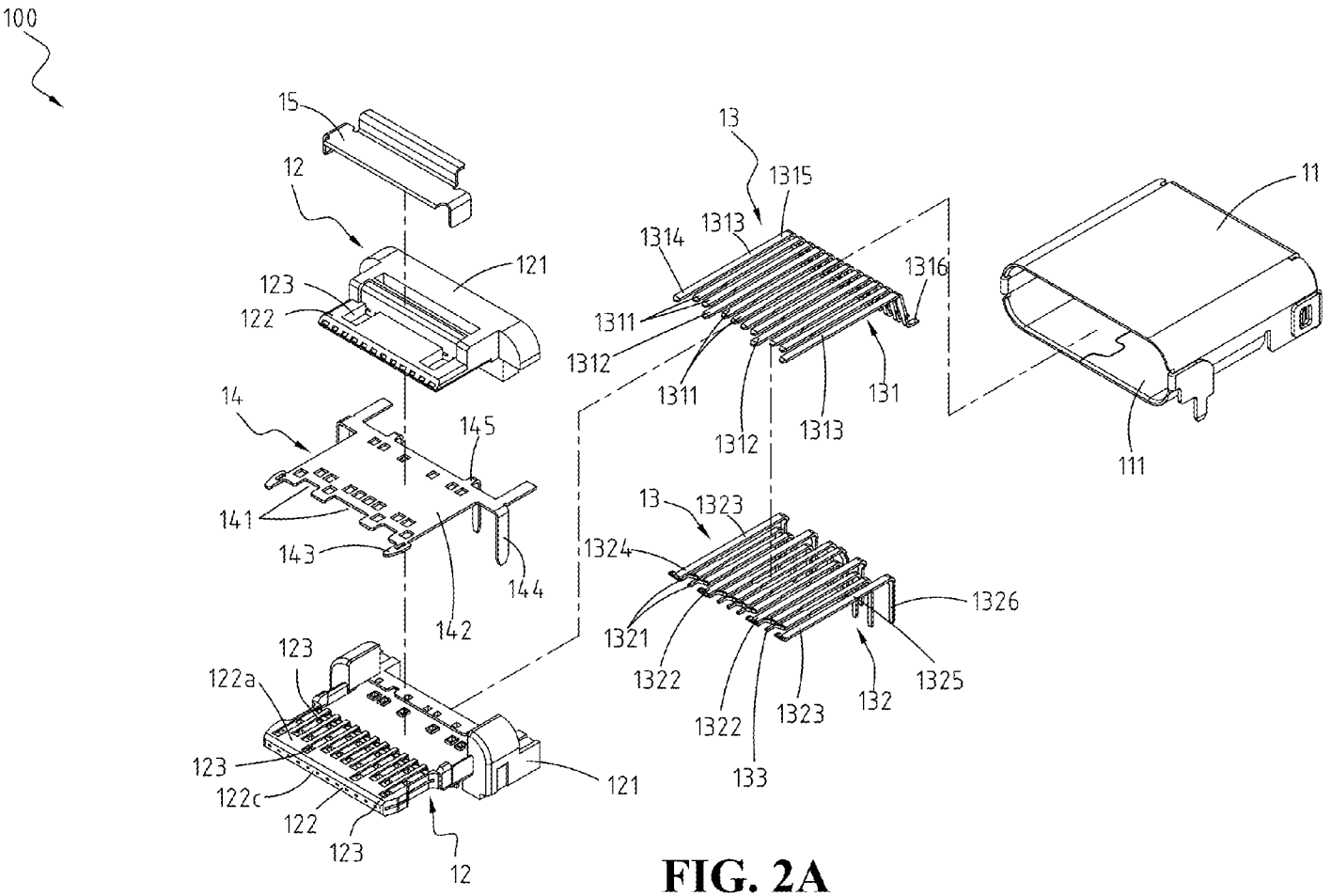
FIG. 2A is an exploded view of an electrical receptacle connector according to the instant disclosure.
Figure 2B:
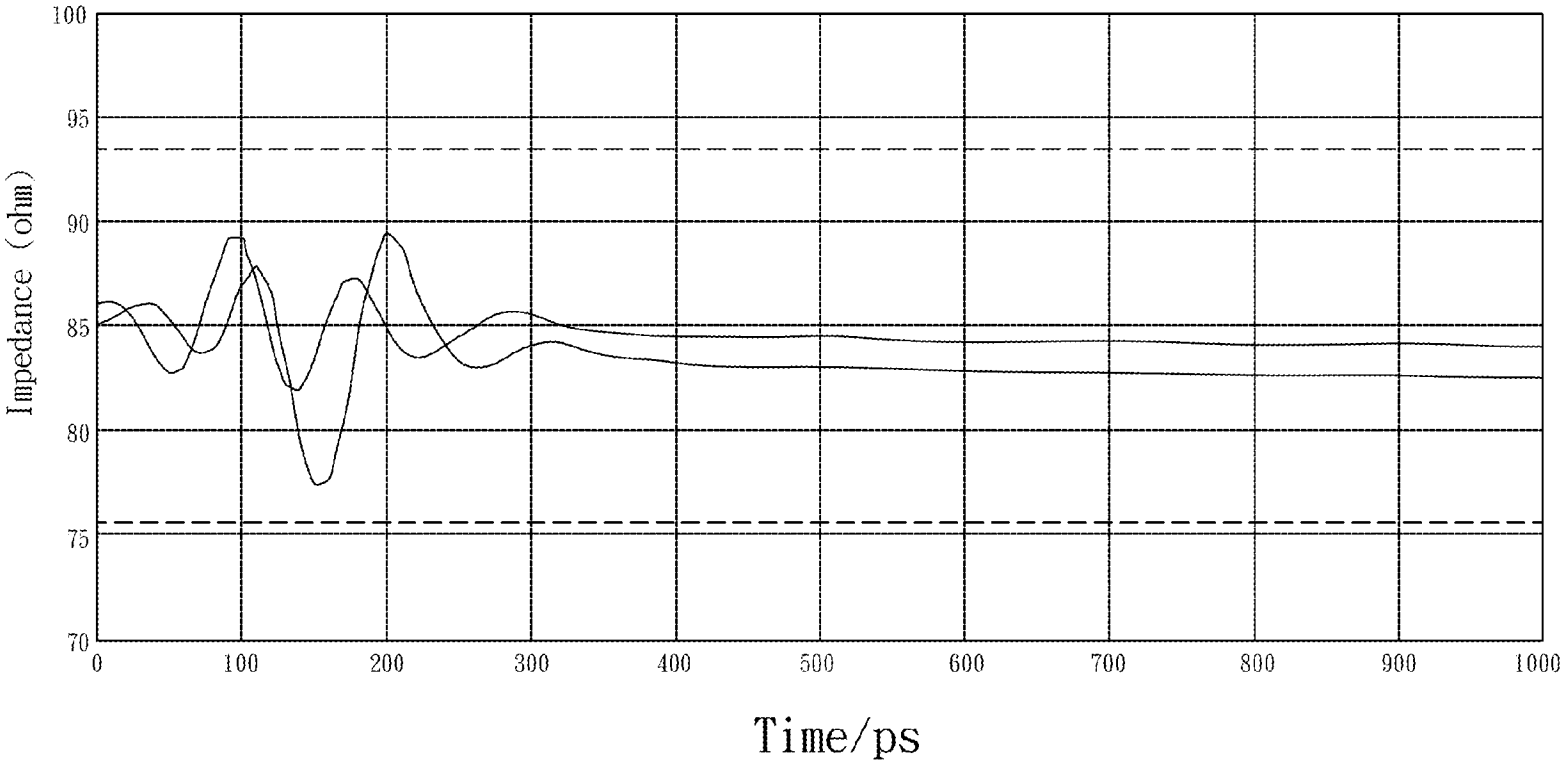
FIG. 2B is a schematic view of a high-frequency test curve for a plurality of receptacle terminals of the electrical receptacle connector according to the instant disclosure.
Figure 3:
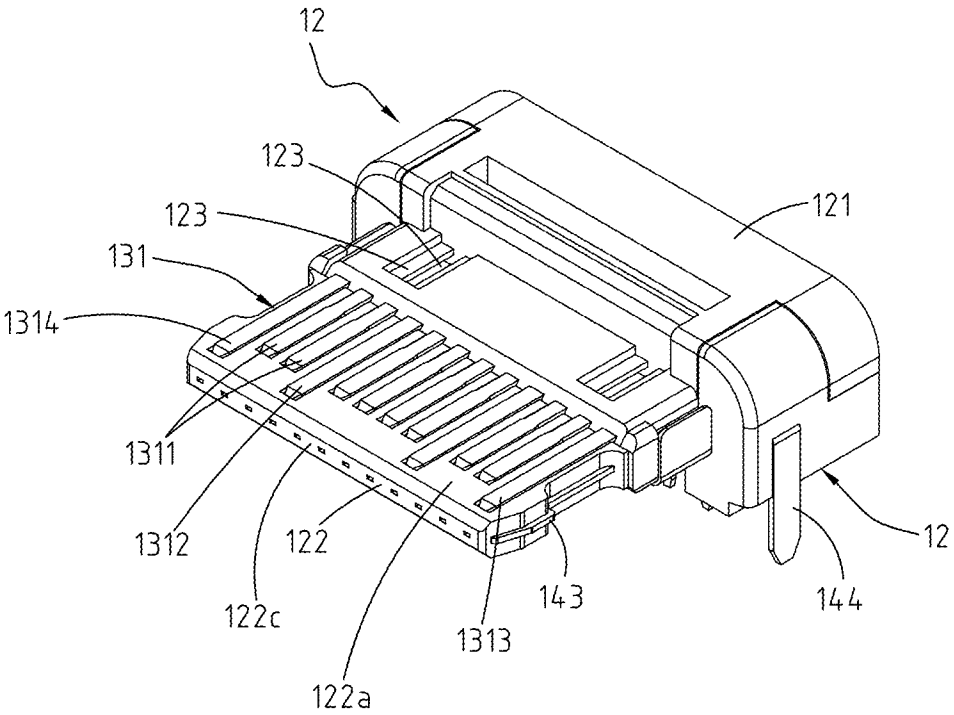
FIG. 3 is a perspective view of the electrical receptacle connector according to the instant disclosure.
Figure 4:
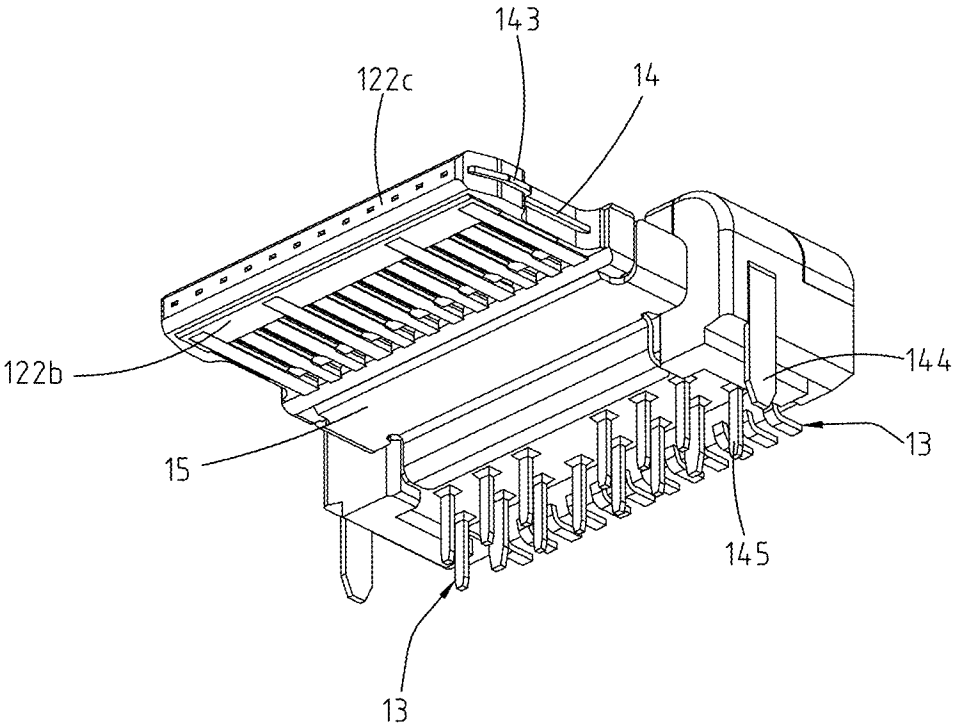
FIG. 4 is another perspective view of the electrical receptacle connector according to the instant disclosure.
Figure 4A:
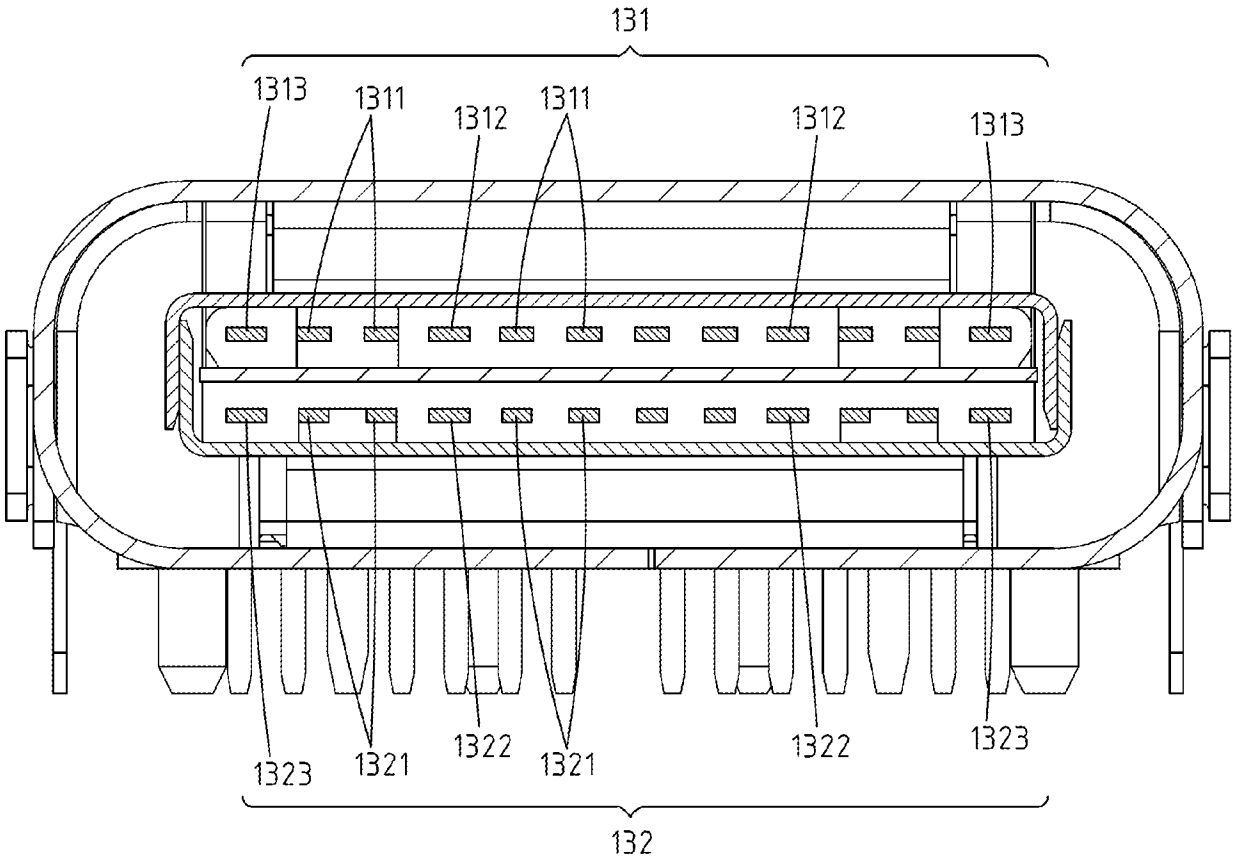
FIG. 4A is a lateral sectional view of the electrical receptacle connector according to the instant disclosure.
Figure 5A:
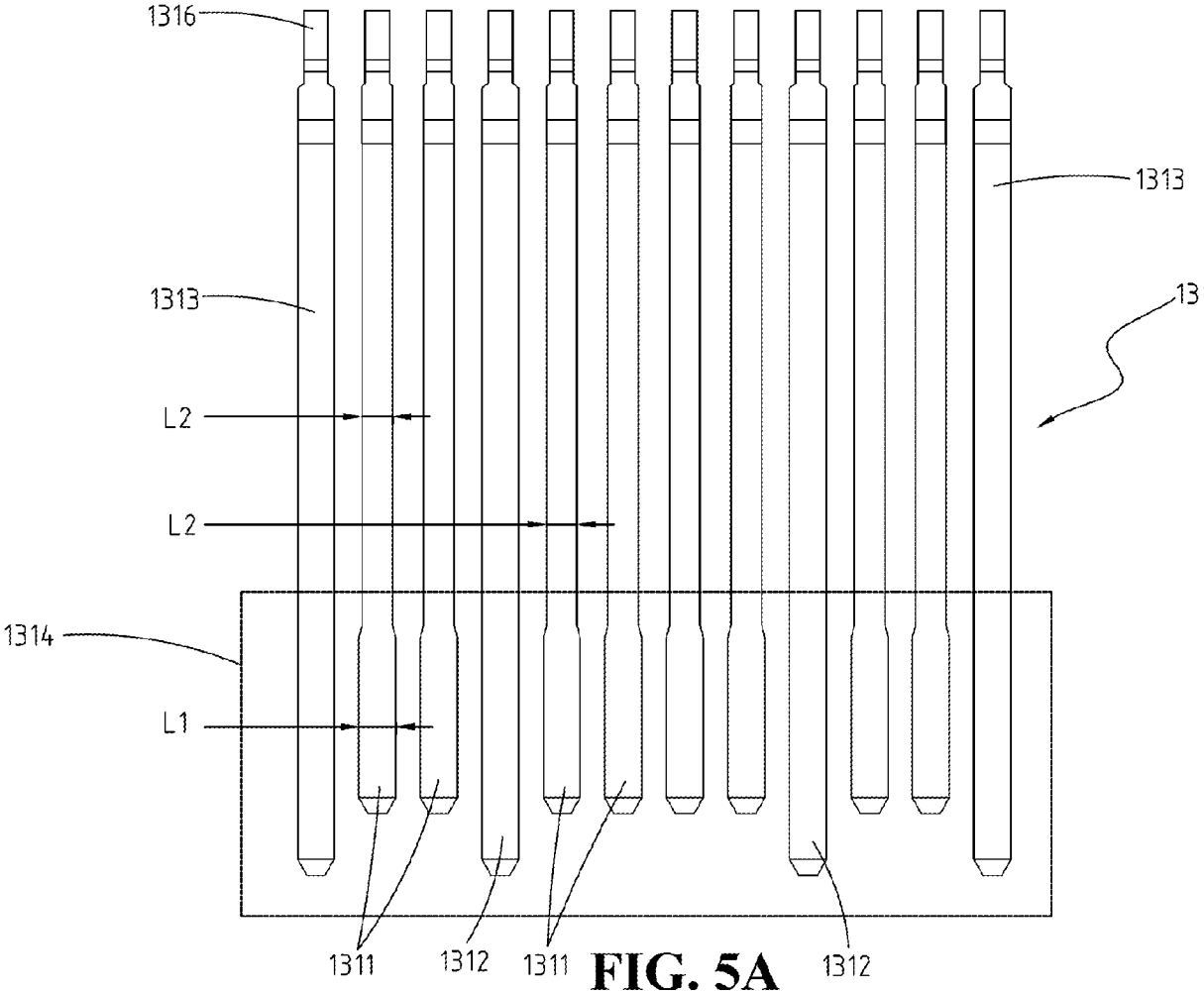
FIG. 5A is a top view of the receptacle terminals of the electrical receptacle connector according to the instant disclosure.

Refer to FIGS. 2A, 2B, 3, 4, 4A, 4B, and 5A, which illustrate an embodiment of an electrical receptacle connector 100 according to the instant disclosure; FIG. 2A is an exploded view of the electrical receptacle connector 100 according to the instant disclosure; FIG. 2B is a schematic view of a high-frequency test curve for a plurality of receptacle terminals 13 of the electrical receptacle connector 100 according to the instant disclosure; FIG. 3 is a perspective view of the electrical receptacle connector 100 according to the instant disclosure; FIG. 4 is another perspective view of the electrical receptacle connector 100 according to the instant disclosure; FIG. 4A is a lateral sectional view of the electrical receptacle connector 100 according to the instant disclosure; FIG. 4B is a schematic configuration diagram of the pin arrangement of the receptacle terminals 13 of the electrical receptacle connector 100 according to the instant disclosure; FIG. 5A is a top view of the receptacle terminals 13 of the electrical receptacle connector 100 according to the instant disclosure. The electrical receptacle connector 100 is in accordance with the specification of a new USB connection interface which can transmit USB 3.0 signals and USB 2.0 signals and is a Type-C USB connection interface. In this embodiment, the electrical receptacle connector 100 comprises a metallic shell 11, an insulated housing 12, and a plurality of receptacle terminals 13. In addition, the electrical receptacle connector 100 further comprises a conductive strip 15 which is disposed at the corner between the bottom side and the front side of a base portion 121 of the insulated housing 12 and is in contact with and electrically connected to an inner wall of the metallic shell 11. The details about the conductive strip 15 are not described herein.

Referring to FIG. 2A, the metallic shell 11 is a hollow shell. The metallic shell 11 defines a receptacle cavity 111 therein; here, the metallic shell 11 is composed of, for example, a unitary or multi-piece member.

Please refer to FIG. 2, FIG. 3 and FIG. 4. The insulated housing 12 is received in the receptacle cavity 112 and comprises the base portion 121 and a tongue portion 122. Here, the base portion 121 and the tongue portion 122 may be integrally injection molded or the like for production of a unitary member, named as the insulated housing 13, and the tongue portion 122 is extended from one side of the base portion 121. Moreover, the insulated housing 12 is composed of, for example, a unitary or multi-piece member. Here, when the insulated housing 12 is a two-piece member, the insulated housing 12 includes an upper base portion and a lower base portion, which are combined to form the insulated housing 12. The receptacle terminals 13 are held in the upper base portion and the lower base portion respectively by insert-molding techniques, but embodiments are not limited thereto; in some implementation aspects, the receptacle terminals 13 could be assembled to the insulated housing. Furthermore, the tongue portion 122 has an upper surface 122*a* and a lower surface 122*b*. The upper surface 122*a* and the lower surface 122*b* are the opposite surfaces of the tongue portion 122. The tongue portion 122 further comprises a front surface 122*c* located between the upper surface 122*a* and the lower surface 122*b* and respectively connected with the upper surface 122*a* and the lower surface 122*b*.

Again, please refer to FIG. 2A, FIG. 3, and FIG. 4, the receptacle terminals 13 are held in the base portion 121 and arranged in the tongue portion 122. The receptacle terminals 13 comprise a plurality of upper-row receptacle terminals 131 and a plurality of lower-row receptacle terminals 132.

Please refer to FIG. 3, FIG. 4, FIG. 4A and FIG. 4B, the upper-row receptacle terminals 131 are held in the base portion 121, arranged in the tongue portion 122, and disposed at the upper surface 122*a* of the tongue portion 122.

Here, the upper-row receptacle terminals 131 comprise a plurality of upper-row signal terminals 1311, at least one power terminal 1312 and at least one ground terminal 1313. Each of the upper-row receptacle terminals 131 is held in the base portion 121, arranged in the tongue portion 122, and disposed at the upper surface 122*a*. As shown in FIG. 4A and FIG. 4B, the upper-row receptacle terminals 131 comprise, from left to right, an upper-row ground terminal 1313 (Gnd), a first pair of differential signal terminals (TX1+−), a second pair of differential signal terminals (D+−), and a third pair of differential signal terminals (RX2+−) of the upper-row signal terminals 1311, upper-row power terminals 1312 (Power/VBUS), between the three pairs of differential signal terminals, a retain terminal (RFU), (the retain terminal and a configuration channel 1 (CC1), are respectively between the upper-row power terminals 2312 and the second pair of differential signal terminals of the upper-row signal terminals 1311), and another upper-row ground terminal 1313 (Gnd).

Please refer to FIG. 2A, FIG. 3, FIG. 4, FIG. 4A and FIG. 4B. Each of the upper-row receptacle terminals 131 comprises an upper-row flat contact portion 1314, an upper-row connecting portion 1315 and an upper-row soldering portion 1316. The upper-row connecting portion 1315 is held in the base portion 121 and the upper-row flat contact portion 1314 is disposed at the upper surface 122*a* of the tongue portion 122. The upper-row flat contact portion 1314 is extended from one of two ends of the upper-row connecting portion 1315 and the upper-row soldering portion 1316 is extend from the other end of the upper-row connecting portion 1315. The upper-row flat contact portion 1314 is disposed at the upper surface 122*a* and the upper-row soldering portion 1316 is protruded out of the base portion 121. The upper-row signal terminals 1311 are disposed at the upper surface 122*a* for transmitting first signals (that is, USB 3.0 signals), and the upper-row soldering portions 1316 are protruded out of the bottom of the base portion 121. Moreover, the upper-row soldering portions 1316 are bent horizontally to form flat legs, named SMT legs, that can be mounted or soldered on the surface of a printed circuit board (PCB) by using surface mount technology, SMT, as shown in FIG. 4.

Please refer to FIG. 2A, FIG. 3, FIG. 4, FIG. 4A and FIG. 4B. The lower-row receptacle terminals 132 are held in the base portion 121 and arranged in the tongue portion 122. Here, the lower-row receptacle terminals 132 comprise a plurality of lower-row signal terminals 1321, at least one lower-row power terminal 1322 and at least one lower-row ground terminal 1323. Each of the lower-row receptacle terminals 132 is held in the base portion 121, disposed at the lower surface 122*b* of the tongue portion 122. As shown in FIG. 4A and FIG. 4B, the lower-row receptacle terminals 132 comprise, from right to left, a lower-row ground terminal 1323 (Gnd), a first pair of differential signal terminals (TX2+−), a second pair of differential signal terminals (D+−) and a third pair of differential signal terminals (RX1+−), of the lower-row signal terminals 1321, lower-row power terminals 1322 (Power/VBUS), between the three pairs of differential signal terminals, a retain terminal (RFU) (the retain terminal and a configuration channel 2 (CC2) are a respectively arranged between the lower-row power terminals 1322 and the second pair of differential signal terminals of the lower-row signal terminals 1321), and another lower-row ground terminal 1323.

Please refer to FIG. 2A, FIG. 3, FIG. 4, FIG. 4A and FIG. 4B. Each of the lower-row receptacle terminals 132 comprises a lower-row flat contact portion 1324, a lower-row connecting portion 1325 and a lower-row soldering portion 1326. The lower-row connecting portion 1325 is held in the base portion 121 and the lower-row flat contact portion 1324 is arranged in the tongue portion 122. The lower-row flat contact portion 1324 is extended from one of two ends of the lower-row connecting portion 1325 and the lower-row soldering portion 1326 is extended from the other end of the lower-row connecting portion 1325. The lower-row flat contact portion 1324 is disposed at the lower surface 122*b* and the lower-row soldering portion 1326 is protruded out of the base portion 121. The lower-row signal terminals 1321 are disposed at the lower surface 122*b* for transmitting second signals (that is, USB 3.0 signals), and the lower-row soldering portions 1326 are protruded out of the bottom of the base portion 121. Moreover, the lower-row soldering portions 1326 are extended downwardly to form vertical legs, named DIP legs, that are inserted into holes drilled in a printed circuit board (PCB), as shown in FIG. 4.

Please refer to FIG. 4A and FIG. 4B. The upper-row receptacle terminals 131 and the lower-row receptacle terminals 132 are respectively disposed at the upper surface 122*a* and the lower surface 122*b* of the tongue portion 122. Additionally, pin-assignments of the upper-row receptacle terminals 131 and the lower-row receptacle terminals 132 are 180 degree symmetrical, dual or double orientation design which enable an electrical plug connector to be inserted into the electrical receptacle connector 100 in either of two intuitive orientations, i.e., in either upside-up or upside-down directions. In other words, the pin-assignments of the upper-row receptacle terminals 131 and the lower-row receptacle terminals 132 have 180 degree symmetrical, dual or double orientation design with respect to a central point of the receptacle cavity 111 as the symmetrical center. Here, point-symmetry means that after the upper-row receptacle terminals 131 (or the lower-row receptacle terminals 132), are rotated by 180 degrees with the symmetrical center as the rotating center, the upper-row receptacle terminals 131 and the lower-row receptacle terminals 132 are overlapped; that is, the rotated upper-row receptacle terminals 131 are arranged at the original position of the lower-row receptacle terminals 132, and the rotated lower-row receptacle terminals 132 are arranged at the original position of the upper-row receptacle terminals 131. In other words, the upper-row receptacle terminals 131 and the lower-row receptacle terminals 132 are upside down, and the pin assignments of the upper-row flat contact portions 1314 are left-right reversal with respect to that of the lower-row flat contact portions 1324. Consequently, an electrical plug connector is inserted into the electrical receptacle connector 100 with a first orientation where the upper surface 122*a* of the tongue portion 122 of the electrical receptacle connector 100 is facing up, for transmitting first signals; conversely, the electrical plug connector is inserted into the electrical receptacle connector 100 with a second orientation where the upper surface 122*a* of the tongue portion 122 of the electrical receptacle connector 100 is facing down, for transmitting second signals. Furthermore, the specification for transmitting the first signals is conformed to the specification for transmitting the second signals. Note that, the inserting orientation of the electrical plug connector for inserting to the electrical receptacle connector 100 is not limited by the instant disclosure.

Please refer to FIG. 4A and FIG. 4B, in which embodiment with a front view of the upper-row receptacle terminals 131 and the lower-row receptacle terminals 132, the pin assignment of the upper-row receptacle terminals 131 corresponds to that of the lower-row receptacle terminals 132.

In this embodiment, the upper-row receptacle terminals 131 and the lower-row receptacle terminals 132 further comprise a plurality of USB 2.0 transmission signal pairs and a plurality of USB 3.0 transmission signal pairs. That is, the upper-row receptacle terminals 131 have several USB 2.0 transmission signal pairs and several USB 3.0 transmission signal pairs, and the lower-row receptacle terminals 132 also have several USB 2.0 transmission signal pairs and several USB 3.0 transmission signal pairs. Moreover, the USB 3.0 transmission signal pairs are at two sides of the USB 2.0 transmission signal pairs, the USB 2.0 transmission signal pairs transmit low-frequency signals, and the USB 3.0 transmission signal pairs transmit high-frequency signals. In addition, the upper-row receptacle terminals 131 comprise the upper-row flat contact portions 1314, the upper-row connecting portions 1315, and the upper-row soldering portions 1316. Conversely, the lower-row receptacle terminals 132 comprise the lower-row flat contact portions 1324, the lower-row connecting portions 1325, and the lower-row soldering portions 1326. That is, each of the USB 2.0 or USB 3.0 transmission signal pairs comprises the flat contact portions 1314, 1324, the connecting portions 1315, 1325, and the soldering portions 1316, 1326. Moreover, the width L1 of the flat contact portions 1314, 1324 conforms to the standard width prescribed by the USB Association (USB-IF), for example, 0.3 mm.

Please refer to FIG. 2A, FIG. 3, FIG. 4 and FIG. 5A. The upper-row flat contact portions 1314 and the lower-row flat contact portions 1324 are respectively arranged in the opposite surfaces of the tongue portion 122. The upper-row soldering portions 1316 and the lower-row soldering portions 1326 are exposed out of the base portion 121, and the upper-row connecting portions 1315 and the lower-row connecting portions 1325 are retained in the insulated housing 12. For each of the terminals 131, 132, the flat contact portions 1314, 1324 are respectively extended from one of two ends of the connecting portion 1315, 1325 and the soldering portions 1316, 1326 are respectively extended from the other end of the connecting portions 1315, 1325. The width L2 of the connecting portions 1315, 1325 is smaller than the width L1 of the flat contact portions 1314, 1324. The interval between two adjacent upper-row flat contact portions 1314 (or two adjacent lower-row flat contact portions 1324) is smaller than the interval between the two corresponding upper-row connecting portions 1315 (or the two corresponding lower-row connecting portions 1325); the width L2 of the connecting portions 1315, 132 is at the range from 0.2 mm to 0.25 mm. That is, in the exemplary embodiment of the instant disclosure, the width L2 of the connecting portion 1315, 1325 is different from the width L1 of the corresponding flat contact portions 1314, 1324.

Figure 5B:
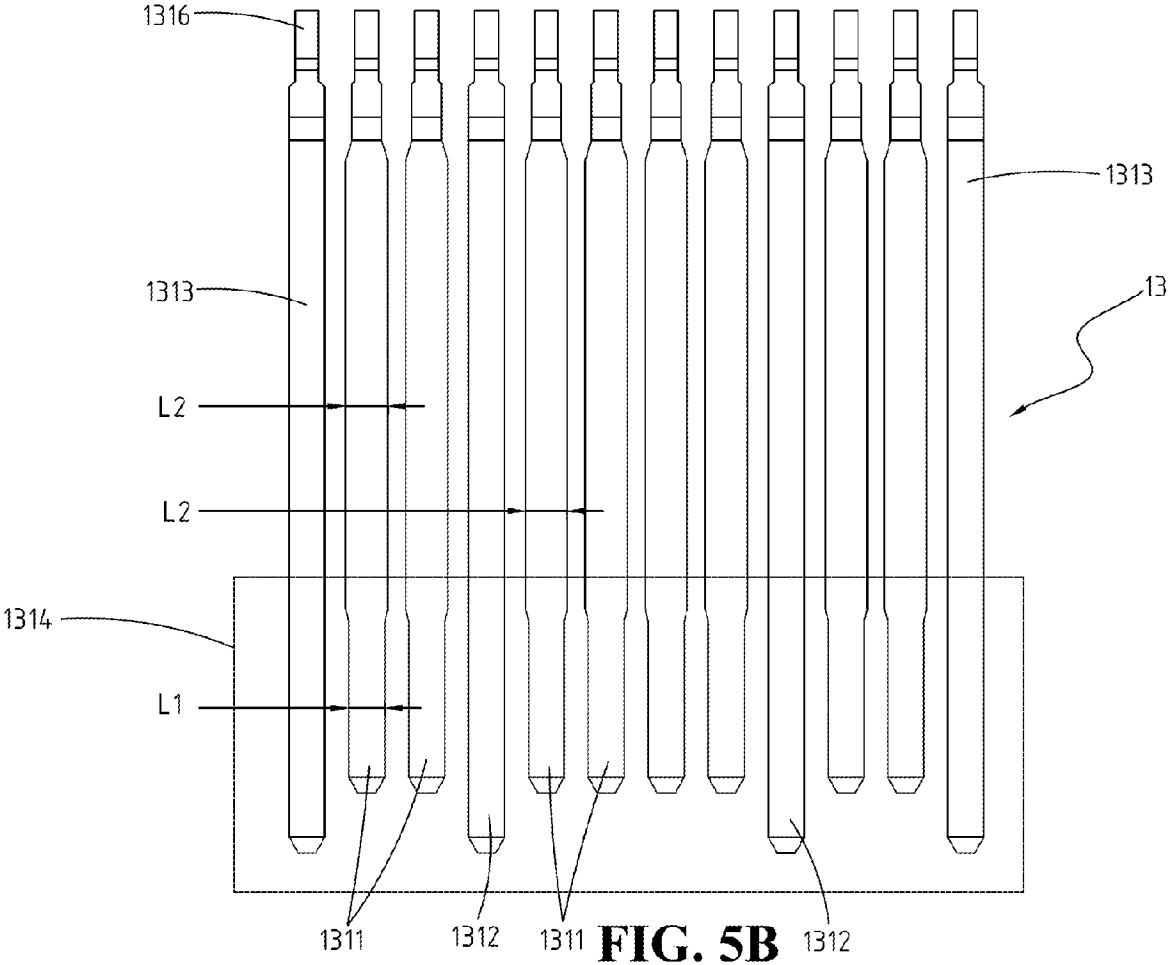
FIG. 5B is a top view of another aspect of the receptacle terminals of the electrical receptacle connector according to the instant disclosure.

Please refer to FIG. 5A and FIG. 5B, which illustrate an exemplary embodiment of another aspect of the receptacle terminals 13 according to the instant disclosure, and FIG. 5B is a top view of another aspect of the receptacle terminals 13 of the electrical receptacle connector 100 according to the instant disclosure. In some implementation aspects, for each of the receptacle terminals 13, the width L2 of the connecting portions 1315, 1325 is greater than the width L1 of the flat contact portions 1314, 1324, the interval between two adjacent flat contact portions 1314, 1324 is greater than that between the two corresponding connecting portions 1315, 1325, and the width L2 of the connecting portions 1315, 1325 is at the range between 0.35 mm to 0.4 mm. In view of the above, the width L2 of the connecting portions 1315, 1325 is different from the width L1 of the corresponding flat contact portions 1314, 1324. Moreover, in this embodiment, per 0.01 mm change of the width L2 of the connecting portion 1315, 1325 shifts the impedance value by a value about 4 to 5 ohm.

Referring to FIGS. 5A and 5B, in this embodiment, widths L2 of the connecting portions 1315, 1325 of the USB 3.0 transmission signal pairs or the connecting portions 1315, 1325 of the USB 2.0 transmission signal pairs are identical. For example, the number of one group of the USB 3.0 transmission signal pairs is 2, the width L2 of the upper-row connecting portion 1315 is identical with the width L2 of the lower-row connecting portion 1325 of each group of the USB 3.0 transmission signal pairs and the widths L2 of the connecting portions 1315, 1325 of each group of the USB 3.0 transmission signal pairs are identical with the widths L2 of the connecting portions 1315, 1325 of each group of the USB 2.0 transmission signal pairs. Moreover, the connecting portions 1315, 1325 of the USB 3.0 transmission signal pairs or the connecting portions 1315, 1325 of the USB 2.0 transmission signal pairs are parallel to each other, have identical shapes and lengths, and perform the identical impedance curve profile for the high-frequency analysis test. Furthermore, the central axes of the flat contact portions 1314, 1324, that of the connecting portions 1315, 1325, and that of the soldering portions 1316, 1326 for each of the receptacle terminals 13 are identical; therefore, during signal transmission, biasing or reducing of signals are less prone to occur, and signals can be transmitted steadily. In addition, in some implementation aspects, the width L2 of the connecting portion 1315, 1325 of the USB 3.0 transmission signal pairs is not identical with the width L2 of the connecting portion 1315, 1325 of the USB 2.0 transmission signal pairs; that is, the width L2 of the connecting portion 1315, 13253 of each of the USB 3.0 transmission signal pairs can be less than or greater than the width L2 of the connecting portion 1315, 1325 of the corresponding USB 2.0 transmission signal pairs.

Referring to FIGS. 2A, 2B, and 5A, in this embodiment, after applying the high-frequency analysis test to the receptacle terminals 13, the impedance value of the high-frequency test curve profile of the receptacle terminals 13 is between 75 and 95 ohm. That is, by changing the width L2 of the connecting portion 1315, 1325 of each of the receptacle terminals 13 to be less than or greater than the width L1 of the corresponding flat contact portions 1314, 1324, the impedance of the receptacle terminals 13 can be adjusted to be within a predefined range; that is, the profile of the impedance curve of the receptacle terminals 13 of the electrical plug connector 100 is smoother than conventional and is not beyond the predefined range, thus the receptacle terminals 13 perform good high-frequency characteristics.

In some embodiments, if the impedance value of the high-frequency test curve profile of the receptacle terminals 13 is below 75 ohm, for example, below the dotted line indicated in FIG. 1B, then the width L2 of the connecting portion 1315, 1325 of each of the receptacle terminals 13 may be widen to be greater than the width L1 of the corresponding flat contact portions 1314, 1324, so that the impedance value of the high-frequency test curve profile of the receptacle terminals 13 can be increased to be between 75 and 95 ohm. Consequently, the impedance of the receptacle terminals 13 is adjustable to allow the receptacle terminals 13 performing good high-frequency characteristics.

Figure 1A:
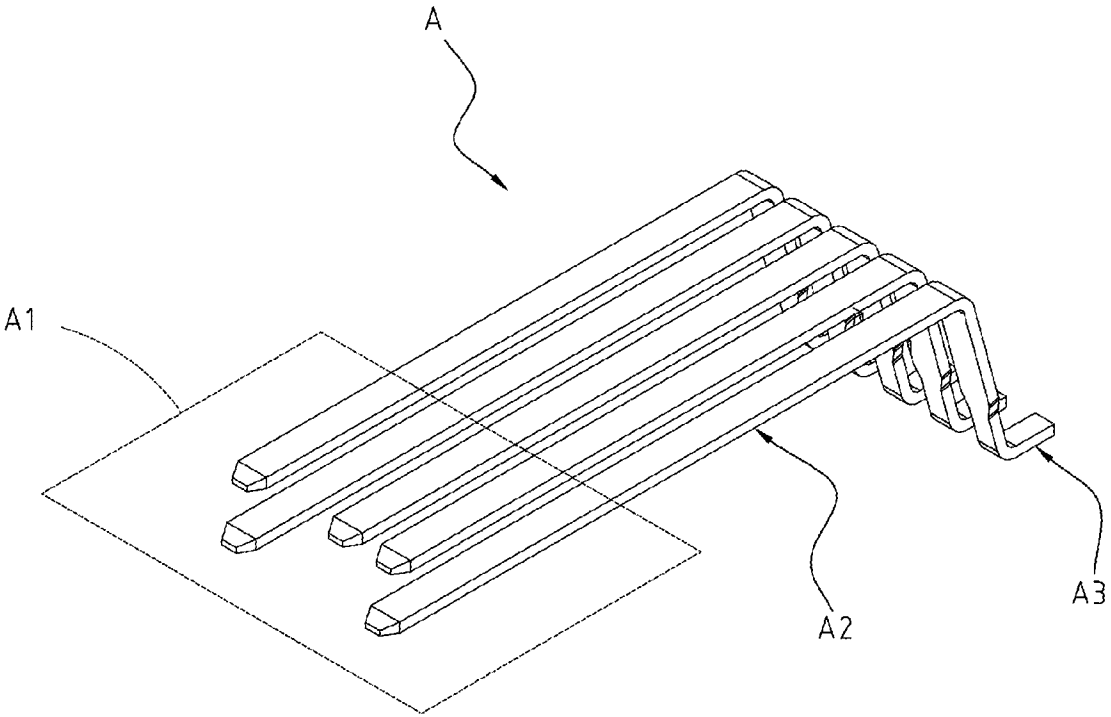
FIG. 1A (Prior Art)
FIG. 1A is a perspective view of a plurality of conventional terminals.
Figure 1B:
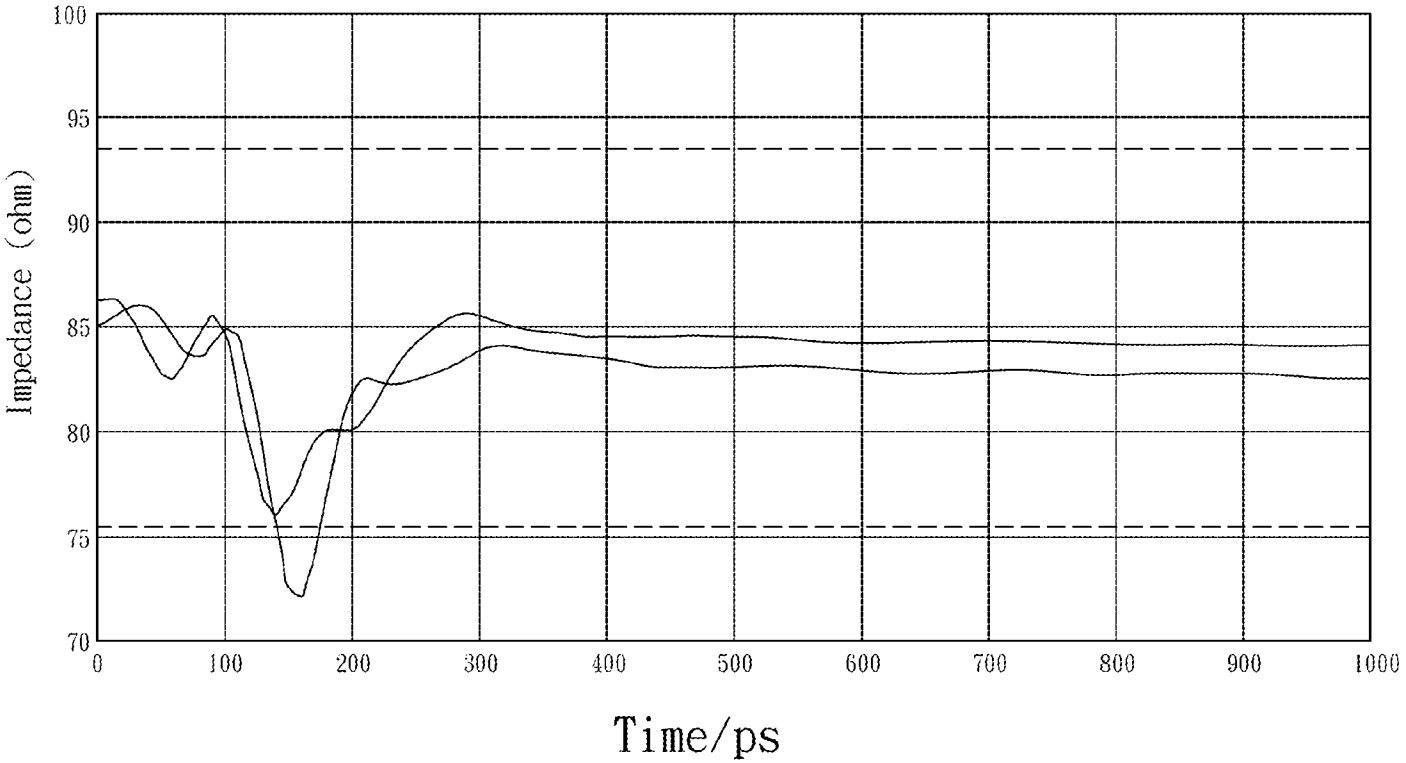
FIG. 1B (Prior Art)
FIG. 1B is a schematic view of a high-frequency test curve for the conventional terminals.

In some embodiments, if, the impedance value of the high-frequency test curve profile of the receptacle terminals 13 is above 95 ohm, for example, beyond the dotted line indicated in FIG. 1B, then the width L2 of the connecting portion 1315, 1325 of each of the receptacle terminals 13 may be further narrow to be less than the width L1 of the corresponding flat contact portions 1314, 1324, so that the impedance value of the high-frequency test curve profile of the receptacle terminals 13 can be reduced and adjusted between 75 and 95 ohm. Consequently, the impedance of the receptacle terminals 13 is adjustable to allow the receptacle terminals 13 performing good high-frequency characteristics.

Referring to FIG. 5A, in this embodiment, the widths L2 of the upper-row connecting portions 1315 are identical with that of the lower-row connecting portions 1325, but embodiments are not limited thereto. In some embodiments, the width L2 of the connecting portion 1315, 1325 of each of the receptacle terminals 13 may be gradually narrowed or widened; alternatively, the width L2 in any position of the connecting portion 1315,1325 of each of the receptacle terminals 13 may be less than or greater than the widths L2 in other positions of the connecting portions 1315, 1325 of the same receptacle terminal 13; alternatively, the width of the connecting portions 1315, 1325 may be altered to allow the outline of the receptacle terminals 13 to be a regular jagged shape or an irregular non-jagged shape, so that, the impedance value of the curve profile of the receptacle terminals 13 is between 75 and 95 ohm. That is, when the impedance value of the high-frequency test curve profile of the receptacle terminals 13 is above 95 ohm, the impedance value of the high-frequency test curve profile of the receptacle terminals 13 can be tuned between 75 and 95 ohm by adjusting the width L2 of the connecting portions 1315, 1325. While when the impedance value of the high-frequency test curve profile of the receptacle terminals 13 is below 75 ohm, the impedance value of the high-frequency test curve profile of the receptacle terminals 13 can be tuned between 75 and 95 ohm by adjusting the width L2 of the connecting portions 1315, 1325. Thus, the impedance of the receptacle terminals is adjustable to allow the receptacle terminals 13 performing good high-frequency characteristics.

Figure 7:
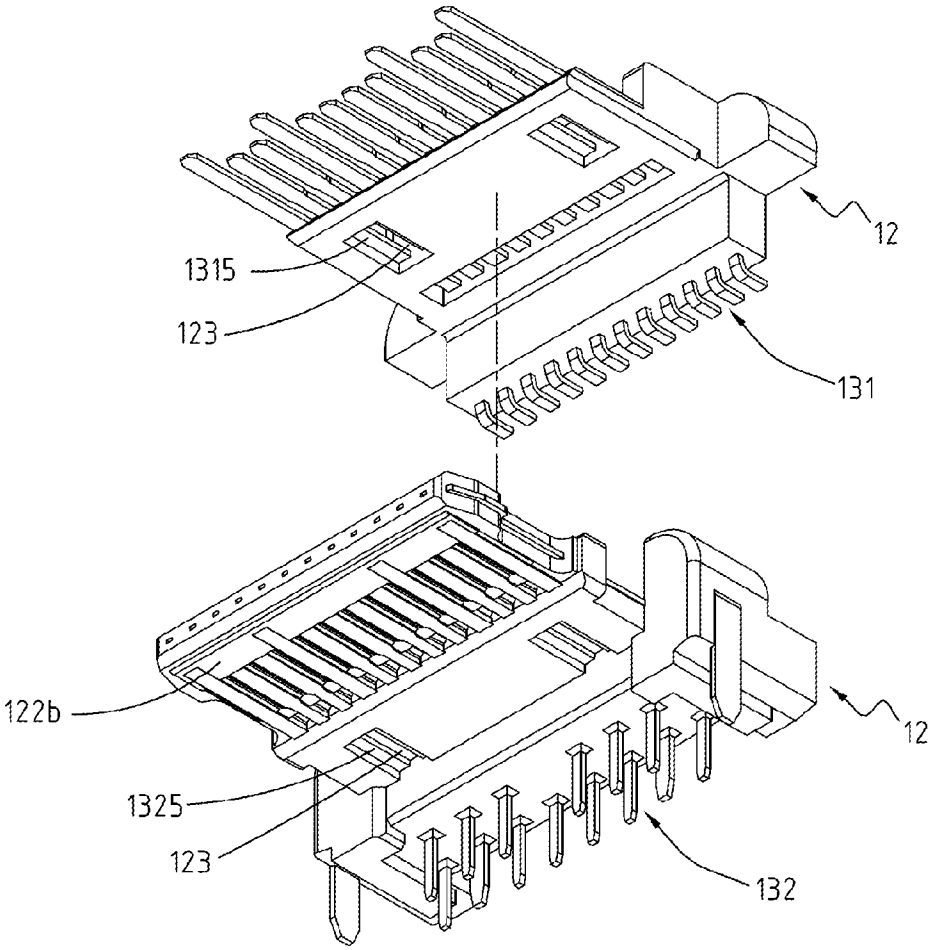
FIG. 7 is an exploded view showing some of the receptacle terminals are exposed from each of a plurality of receptacle material cutout slots.

Refer to FIG. 2A, FIG. 3, and FIG. 7, illustrating an embodiment of the electrical receptacle connector 100 according to the instant disclosure comprises a plurality of grooves or through holes 123. FIG. 7 is a partly exploded view showing that the regions of at least one portion of the insulated housing 12 corresponding to the terminal slots for receiving the receptacle terminals 13 form grooves or through holes to expose the parts of the receptacle terminals 13 to air. The grooves or through holes 123 are formed at the upper surface 122*a* and the lower surface 122*b* of the tongue portion 122. In this embodiment, the receptacle terminals 13 are embedded in the tongue portion 122, and portions of the tongue portion 122 corresponding to the connecting portions 1315, 1325 are partially removed to form recesses, named the grooves or through holes 123, so that some of the connecting portions 1315, 1325 are exposed from the grooves or through holes 123. Alternatively, in some embodiments, the portions of the tongue portion 122 corresponding to the connecting portions 1315, 1325 are completely removed to form through holes so that from the two openings of the grooves or through holes 123 some of the connecting portions 1315, 1325 are exposed to air. The regions of the insulated housing 12 corresponding to the terminal slots for receiving the flat contact portions 1314 of the upper-row receptacle terminals 131 and the flat contact portions 1324 of the lower-row receptacle terminals 132 form grooves or through holes 123 to expose the parts of the flat contact portions 1314 and the flat contact portions 1324 to air. Alternatively, the regions of the grooves or through holes 123 may be formed corresponding to the terminal slots for receiving the upper-row connecting portions 1315 and the lower-row connecting portions 1325 to expose the parts of the upper-row connecting portions 1315 and the lower-row connecting portions 1325 to air. That is, the grooves or through holes 123 are defined at the positions corresponding to the upper-row flat contact portions 1314 and the lower-row flat contact portions 1324 of the USB 3.0 transmission signal pairs of the upper-row receptacle terminals 131 and the lower-row receptacle terminals 132, or are defined at the positions corresponding to the upper-row connecting portions 1315 and the lower-row connecting portions 1325, but are not defined at the positions corresponding to the USB 2.0 transmission signal pairs of the upper-row receptacle terminals 131 and the lower-row receptacle terminals 132.

The permittivities of the components of the electrical receptacle connector 100 affect the high-frequency characteristics of the electrical receptacle connector 100. In this embodiment, the USB 3.0 transmission signal pairs are exposed to air through the grooves or through holes 123, thereby making the USB 3.0 transmission signal pairs be exposed to air. Since the permittivity of the air is lower than that of the insulated housing 12, when the USB 3.0 transmission signal pairs are not in contact with the insulated housing 12, the receptacle terminals 13 perform good high-frequency characteristics. In addition, the larger the material removal area of the grooves or through holes 123 is, the larger the area of the USB 3.0 transmission signal pairs to be exposed to air is. Consequently, the receptacle terminals 13 further perform good high-frequency characteristics. After the high-frequency test is applied on the receptacle terminals 13, the curve profile of the impedance value of the receptacle terminals 13 can be adjusted between 75 and 95 ohm according to the number or the material removal area of the grooves or through holes 123.

Figure 6:
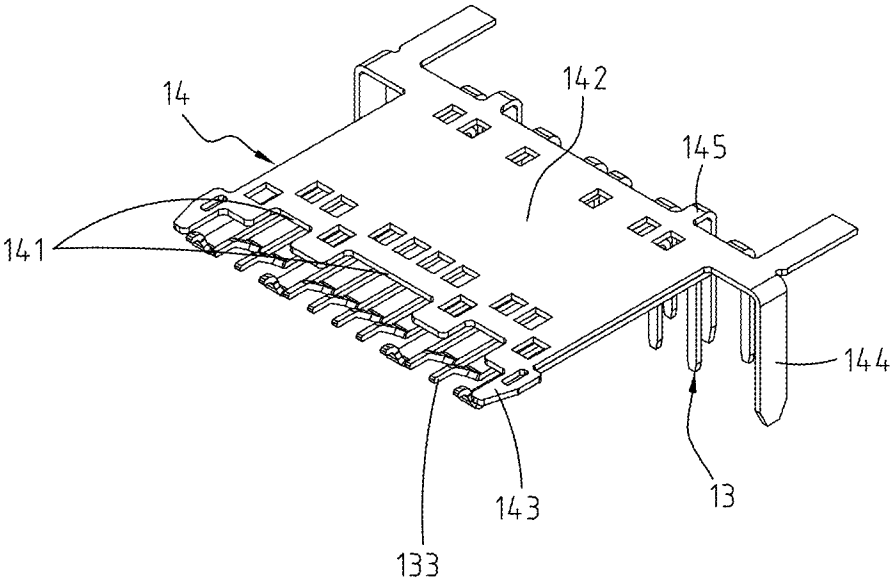
FIG. 6 is a perspective view showing a grounding plate and the receptacle terminals according to the instant disclosure.

Refer to FIG. 2A and FIG. 6, which illustrate an embodiment of the receptacle terminals 13 with a grounding plate 14 according to the instant disclosure, and FIG. 6 is a perspective view showing the grounding plate 14 and the receptacle terminals 13. In some embodiments, the electrical receptacle connector 100 further comprises a grounding plate 14, and the grounding plate 14 is embedded inside the tongue portion 122. The grounding plate 14 comprises a plurality of recessed portions 141 at a front end thereof. Intervals are defined between each two adjacent recessed portions 141, so that the outline of the front end of the grounding plate 14 is of irregular shape, that is, the front end of the grounding plate 14 forms as a concave-convex outline. Moreover, the recessed portions 141 correspond to the flat contact portions 1314, 1324 such that the impedance of the receptacle terminals 13 can be adjusted so as to perform good high-frequency characteristics. In addition, each of the flat contact portions 1314, 1324 comprises a bending segment 133. The bending segments 133 are adjacent to the recessed portions 141 of the grounding plate 14, respectively, so that the bending segments 133 and the grounding plate 14 are aligned at the same horizontal line. Because of the recessed portions 141, efficient structural arrangements and configurations, the grounding plate 14 can be prevented from colliding with the bending segments 1311. In addition, because of the grounding plate 14 embedded inside the tongue portion 122, the upper-row receptacle terminals 131 and the lower-row receptacle terminals 132 are separated by the grounding plate 14, and the crosstalking between the upper-row receptacle terminals 131 and the lower-row receptacle terminals 132 can be prevented. Please refer to FIGS. 2A, 3, 4 and 6, the grounding plate 14 further comprises a body portion 142, two projecting engaging portions 143, two side pins 144, and a plurality of rear pins 145. The projecting engaging portions 143 are disposed at two sides of side of the body portion 142, near the front surface 122*c*, and protruded out of side surfaces of the tongue portion 122. Furthermore, two sides of the body portion 142 are protruded out of the side surfaces of the tongue portion 122. The side pins 143 are extended from the sides of body portion 142 and bent downwardly and protruded out of the base portion 121. The rear pins are extended from a rear side of body portion 142 and bent downwardly and protruded out of the base portion 121.

Figure 8:
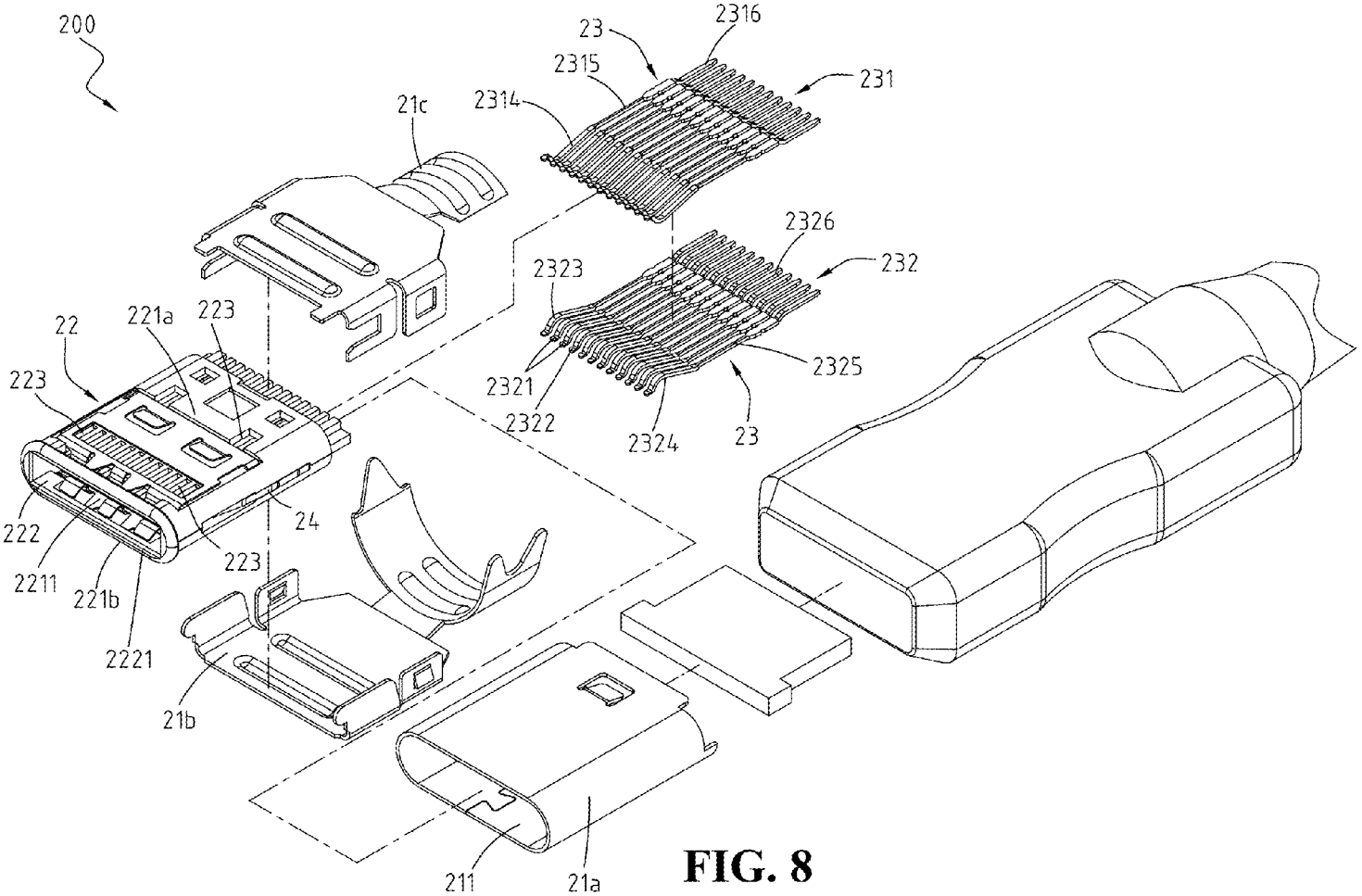
FIG. 8 is an exploded view of an electrical plug connector according to the instant disclosure.
Figure 9A:
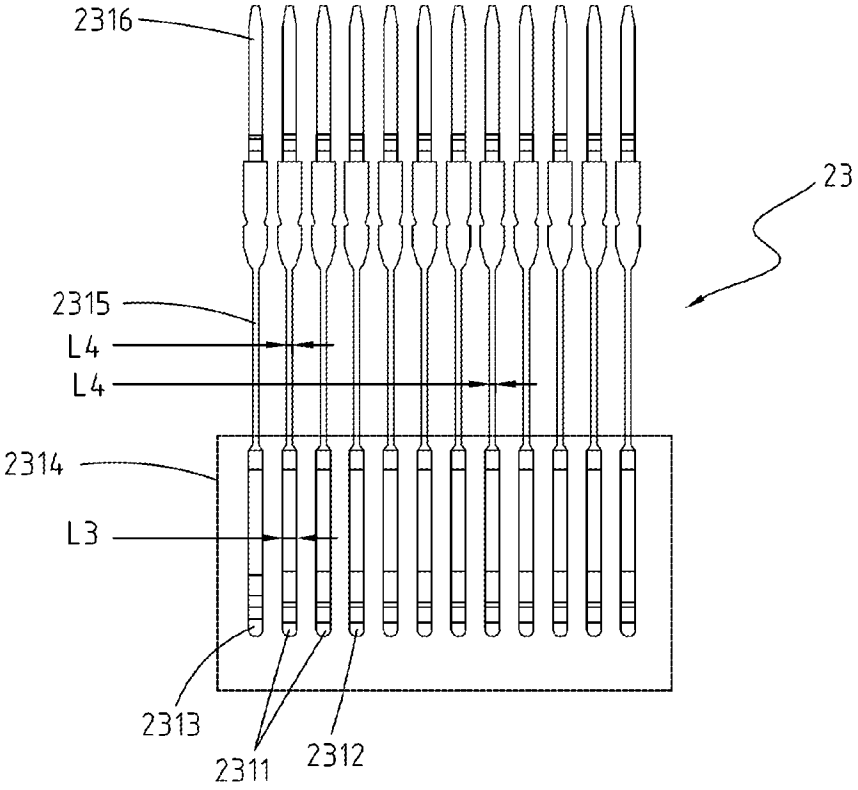
FIG. 9A is a top view of the plug terminals of the electrical plug connector according to the instant disclosure.

FIG. 8 and FIG. 9 illustrate an embodiment of an electrical plug connector 200 according to the instant disclosure; FIG. 8 is an exploded view of the electrical plug connector 200 according to the instant disclosure, and FIG. 9A is a top view of the plug terminals 23 of the electrical plug connector 200 according to the instant disclosure. The electrical plug connector 200 is in accordance with the specification of a new USB connection interface, and can transmit USB 3.0 signals and USB 2.0 signals; moreover, the electrical plug connector 200 is in accordance with the specification of a Type-C USB connection interface. In this embodiment, the electrical plug connector 200 comprises a metallic shell 21, an insulated housing 22, and a plurality of plug terminals 23. In addition, a rear side of the insulated housing 22 is further mounted to a printed circuit board and the plug terminals 23 are soldered on the printed circuit board (PCB). The metallic shell 21 is further externally enclosed by an outer shell, the details about the outer shell and the circuit board are not described herein.

Referring to FIG. 8, the metallic shell 21 is a hollow shell. The metallic shell 21 defines a receiving cavity 211 therein. The metallic shell 21 is composed of, for example, a unitary or multi-piece member. For example, as shown in FIG. 8, the metallic shell 21 is composed of an outer shell 21*a*, an upper shell 21*b*, and a lower shell 21*c*. The outer shell 21*a* is defined the receiving cavity 211. The upper shell 21*b* and the lower shell 21*c* are combined to enclose the insulated housing 22, and received in the receiving cavity 211.

Please refer to FIG. 8; in which the insulated housing 22 comprises an upper portion 221*a* and a lower portion 221*b* and defines an insertion cavity 222. Furthermore, the upper portion 221*a* and the lower portion 221*b* of the insulated housing 22 may be integrally injection molded respectively. In addition, the insertion cavity 222 is between the upper portion 221*a* and the lower portion 221*b*. Moreover, the upper portion 221*a* has a lower surface 2211, the lower portion 221*b* has an upper surface 2221, and the lower surface 2211 of the upper portion 221*a* corresponds to the upper surface 2221 of the lower portion 221*b*.

Figure 8A:
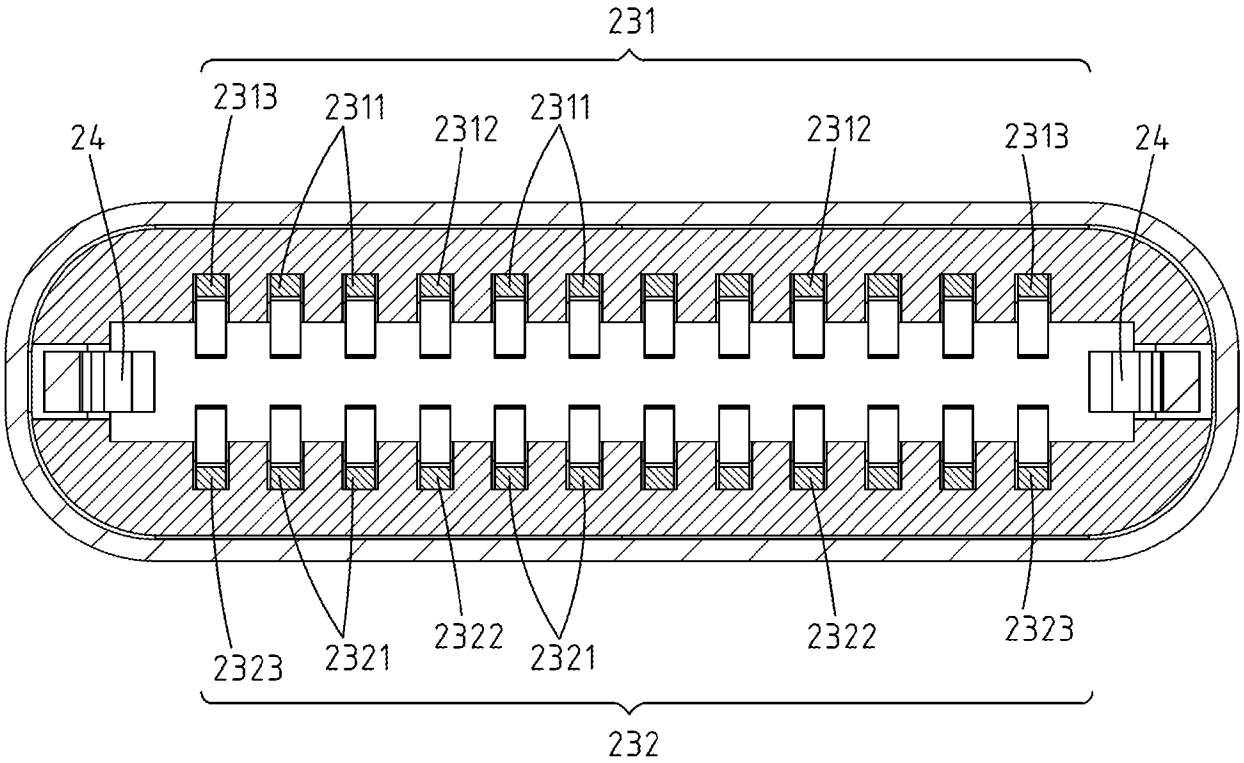
FIG. 8A is a lateral sectional view of the electrical plug connector according to the instant disclosure.

Please Refer to FIG. 8, FIGS. 8A and 9A, the plug terminals 23 are at the upper portion 221*a* and the lower portion 221*b*. In this embodiment, the plug terminals 23 comprises a plurality of upper-row plug terminals 231 and a plurality of lower-row plug terminals 232. The upper-row plug terminals 231 and the lower-row plug terminals 232 comprise a plurality of USB 2.0 transmission signal pairs and a plurality of USB 3.0 transmission signal pairs. That is, the upper-row plug terminals 231 have several USB 2.0 transmission signal pairs and several USB 3.0 transmission signal pairs, and the lower-row plug terminals 232 also have several USB 2.0 transmission signal pairs and several USB 3.0 transmission signal pairs. Moreover, the USB 3.0 transmission signal pairs are at two sides of the USB 2.0 transmission signal pairs. The USB 2.0 transmission signal pairs transmit low-frequency signals, and the USB 3.0 transmission signal pairs transmit high-frequency signals.

In addition, each of the upper-row plug terminals 231 comprises an upper-row elastic contact portion 2314, an upper-row soldering portion 2316 and an upper-row connecting portion 2315. Each of the lower-row plug terminals 232 comprises a lower-row elastic contact 2324, a lower-row soldering portion 2326 and a lower-row connecting portion 2325. That is, each of the USB 2.0 or USB 3.0 transmission signal pairs comprises the elastic contact portions 2314, 2324, the connecting portions 2315, 2325 and the soldering portions 2316, 2326. Moreover, the elastic contact portions 2314, 2324 can be in contact with the flat contact portions 1314, 1324 of the electrical receptacle connector 100, respectively.

Please refer to FIG. 8 and FIG. 9A. Each of the elastic contact portions 2314, 2324 is projected toward an interior space of the insertion cavity 222, and each of the soldering portions 2316, 2326 is exposed out of the insulated housing 22. The connecting portions 2315, 2325 are retained in the insulated housing 22. The elastic contact portions 2314, 2324 are extended from one of two ends of the connecting portions 2315, 2325, and the soldering portions 2315, 2326 are extended from the other end of the connecting portions 2315, 2325. The width L4 of the connecting portions 2315, 2325 is smaller than the width L3 of the elastic contact portions 2314, 2324. The interval between two adjacent upper-row elastic contact portions 2314 (or two adjacent lower-row elastic contact portions 2324) is smaller than the interval between the two corresponding upper-row connecting portions 2315 (or the two corresponding lower-row connecting portions 2325), but embodiments are not limited thereto.

Please refer to FIG. 8, FIG. 8A and FIG. 8B, the upper-row plug terminals 231 are held in the insulated housing 22 and disposed at the lower surface 2211 of the upper portion 221*a*. Here, the upper-row plug terminals 231 comprise a plurality of upper-row signal terminals 2311, at least one power terminal 2312 and at least one ground terminal 2313. Each of the upper-row plug terminals 231 is held in the insulated housing 22 and disposed at the lower surface 2211 of the upper portion 221*a*. As shown in FIG. 8A and FIG. 8B, the upper-row plug terminals 231 comprise, from right to left, an upper-row ground terminal 2313 (Gnd), a first pair of differential signal terminals (TX1+−), a second pair of differential signal terminals (D+−), and a third pair of differential signal terminals (RX2+−) of the upper-row signal terminals 2311, upper-row power terminals 2312 (Power/VBUS), between the three pairs of differential signal terminals, a retain terminal (RFU), (the retain terminal and a configuration channel 1 (CC1), are respectively between the upper-row power terminals 2312 and the second pair of differential signal terminals of the upper-row signal terminals 2311), and another upper-row ground terminal 2313 (Gnd).

Please refer to FIG. 8, FIG. 8A and FIG. 8B. The upper-row connecting portions 2315 are held in the upper portion 221*a*; the upper-row elastic contact portions 2314 are disposed at the lower surface 2211 of the upper portion 221*a* and the upper-row soldering portions 2316 are protruded out of the insulated housing 22. The upper-row elastic signal terminals 2311 are extended toward the opening of the insertion cavity 222 for transmitting first signals (that is, USB 3.0 signals), and the upper-row soldering portions 2316 are extended toward a rear side of the insulated housing 22; moreover, the upper-row soldering portions 2316 are bent horizontally, as shown in FIG. 8.

Please refer to FIG. 8, FIG. 8A and FIG. 8B, the lower-row plug terminals 232 are held in the insulated housing 22 and disposed at the upper surface 2221 of the lower portion 221*b*. The lower-row plug terminals 232 comprise a plurality of lower-row signal terminals 2321, at least one lower-row power terminal 2322 and at least one lower-row ground terminal 2323. Each of the lower-row plug terminals 232 is held in the insulated housing 22 and disposed at the upper surface 2221 of the lower portion 221*b*. As shown in FIG. 8A and FIG. 8B, the lower-row plug terminals 232 comprise, from left to right, a lower-row ground terminal 2323 (Gnd), a first pair of differential signal terminals (TX2+−), a second pair of differential signal terminals (D+−) and a third pair of differential signal terminals (RX1+−), of the lower-row signal terminals 2321, lower-row power terminals 2322 (Power/VBUS), between the three pairs of differential signal terminals, a retain terminal (RFU) (the retain terminal and a configuration channel 2 (CC2) are a respectively arranged between the lower-row power terminals 2322 and the second pair of differential signal terminals of the lower-row signal terminals 2321), and another lower-row ground terminal 2323.

Please refer to FIG. 8, FIG. 8A and FIG. 8B; the lower-row connecting portions 2325 are held in the lower portion 221*b*; the lower-row elastic contact portions 2324 are partly disposed at the upper surface 2221 of the lower portion 221*b* and the lower-row soldering portions 2326 are protruded out of the insulated housing 22. The lower-row signal terminals 2321 are projected into the insertion cavity 222 for transmitting second signals (that is, USB 3.0 signals), and the lower-row soldering portions 2326 are extended toward the rear side of the insulated housing 22; moreover, the lower-row soldering portions 2326 are bent horizontally, as shown in FIG. 8.

Please refer to FIG. 8, FIG. 8A and FIG. 8B, in which the upper-row plug terminals 231 and the lower-row plug terminals 232 are respectively disposed at the lower surface 2211 of the upper portion 221*a* and the upper surface 2221 of the lower portion 221*b*. Additionally, pin-assignments of the upper-row plug terminals 231 and the lower-row plug terminals 232 are 180 degree symmetrical, dual or double orientation design which enable the electrical plug connector 200 to be inserted into the electrical receptacle connector 100 in either of two intuitive orientations, i.e., in either upside-up or upside-down directions. In other words, the pin-assignments of the upper-row plug terminals 231 and the lower-row plug terminals 232 have 180 degree symmetrical, dual or double orientation design with respect to a central point of the receiving cavity 211 as the symmetrical center. Here, point-symmetry means that after the upper-row plug terminals 231 (or the lower-row plug terminals 232), are rotated by 180 degrees with the symmetrical center as the rotating center, the upper-row plug terminals 231 and the lower-row plug terminals 232 are overlapped; that is, the rotated upper-row plug terminals 231 are arranged at the original position of the lower-row plug terminals 232, and the rotated lower-row plug terminals 232 are arranged at the original position of the upper-row plug terminals 231. In other words, the upper-row plug terminals 231 and the lower-row plug terminals 232 are upside down, and the pin assignments of the upper-row elastic contact portions 2314 are left-right reversal with respect to that of the lower-row elastic contact portions 2324. Consequently, the electrical plug connector 200 is inserted into the electrical receptacle connector 100 with a first orientation where the upper surface 122*a* of the tongue portion 122 of the electrical receptacle connector 100 is facing up, for transmitting first signals; conversely, the electrical plug connector 200 is inserted into the electrical receptacle connector 100 with a second orientation where the upper surface 122*a* of the tongue portion 122 of the electrical receptacle connector 100 is facing down, for transmitting second signals. Furthermore, the specification for transmitting the first signals is conformed to the specification for transmitting the second signals. Note that, the inserting orientation of the electrical plug connector 200 for inserting to the electrical receptacle connector 100 is not limited by the instant disclosure.

Please refer to FIG. 8, FIG. 8A and FIG. 8B, in which embodiment with a front view of the upper-row plug terminals 231 and the lower-row plug terminals 232, the pin assignment of the upper-row plug terminals 231 corresponds to that of the lower-row plug terminals 232.

Figure 9B:
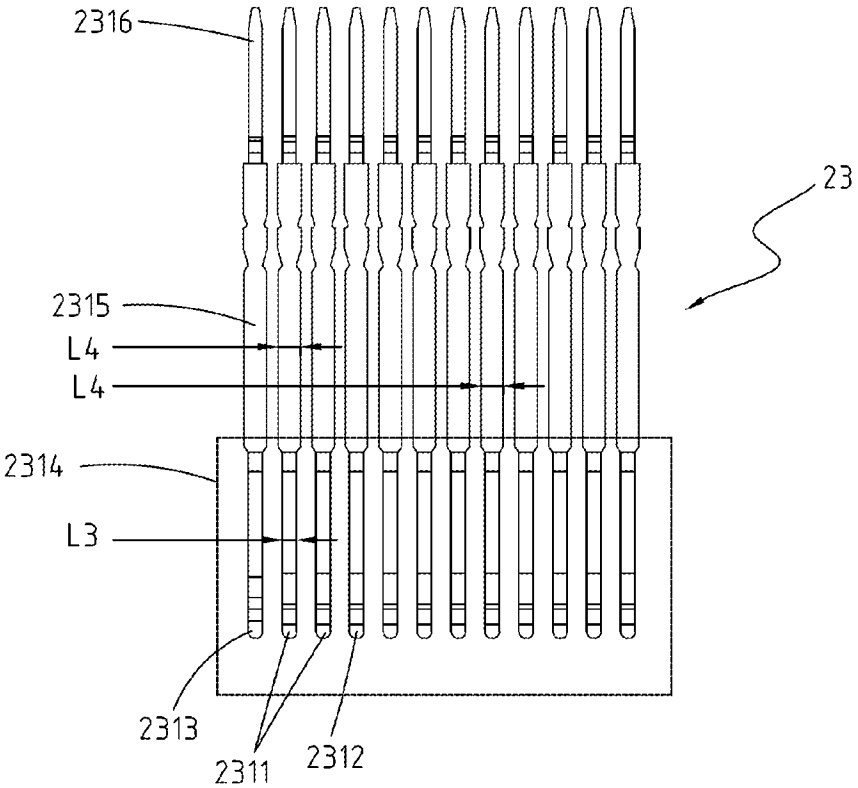
FIG. 9B is a top view of another aspect of the plug terminals of the electrical plug connector according to the instant disclosure.

Referring to FIG. 9B, in some implementation aspects, for each of the upper-row plug terminals 231, 232, the width L4 of the connecting portion 2315, 2325 is greater than the width L3 of the elastic contact portions 2314, 2324, and the interval between two adjacent elastic contact portions 2314, 2324 is greater than that between the two corresponding connecting portions 2315, 2325. In view of the above, the width L4 of the connecting portions 2315, 2325 is different from the width L3 of the corresponding elastic contact portions 2314, 2324. Moreover, in this embodiment, per 0.01 mm change of the width L4 of the connecting portions 233 shifts the impedance value by a value about 4 to 5 ohm.

Referring to FIG. 9A, in this embodiment, widths L4 of the connecting portions 2315, 2325 of the USB 3.0 transmission signal pairs or the connecting portions 2315, 2325 of the USB 2.0 transmission signal pairs are identical. For example, the number of one group of the USB 3.0 transmission signal pairs is 2, the width L4 of the upper-row connecting portion 2315 is identical with the width L4 of the lower-row connecting portion 2325 of each group of the USB 3.0 transmission signal pairs, and the widths L4 of the connecting portions 2315, 2315 of each group of the USB 3.0 transmission signal pairs are identical with the widths L4 of the connecting portions 2315, 2325 of each group of the USB 2.0 transmission signal pairs. Moreover, the connecting portions 2315, 2325 of the USB 3.0 transmission signal pairs or the connecting portions 2315, 2325 of the USB 2.0 transmission signal pairs are parallel to each other, have identical shapes and lengths, and perform identical impedance curve or profile for the high-frequency analysis test. Furthermore, the central axes of the pin-type contacts 2314, 2324, that of the connecting portions 2315, 2325 and that of the soldering portions 2316, 2326 for each of the plug terminals 23 are identical; therefore, during signal transmission, biasing or reducing of signals are less prone to occur, and signals can be transmitted steadily. In addition, in some implementation aspects, the width L4 of the connecting portion 2315, 2325 of the USB 3.0 transmission signal pairs are not be identical with the width L4 of the connecting portion 2315, 2325 of the USB 2.0 transmission signal pairs, that is, the widths L4 of the connecting portions 2315, 2325 of each group of the USB 3.0 transmission signal pairs can be less than or greater than the widths L4 of the connecting portions 2315, 2325 of the corresponding USB 2.0 transmission signal pairs.

Referring to FIG. 9A, in this embodiment, the widths L4 of the upper-row connecting portions 2315 are identical with that of the lower-row connecting portions 2325, but are not limited thereto. In some embodiments, the widths L4 of the connecting portion 2315, 2325 of each of the plug terminals 23 may be gradually narrowed or widened; alternatively the width L4 in any position of the connecting portions 2315, 2325 of each of the plug terminals 23 may be less than or greater than the widths L4 in other positions of the connecting portions 2315, 2325 of the same plug terminal 23. Alternatively, the width of the connecting portions 2315, 2325 may be altered to allow the outline of the plug terminals 23 to be a regular jagged shape or an irregular non-jagged shape, so that the impedance value of the curve profile of the plug terminals 23 is between 75 and 95 ohm. That is, when the impedance value of the high-frequency test curve profile of the plug terminals 23 is above 95 ohm, the impedance value of the high-frequency test curve profile of the plug terminals 23 can be tuned between 75 and 95 ohm by adjusting the widths L4 of the connecting portions 233. When the impedance value of the high-frequency test curve profile of the plug terminals 23 is below 75 ohm, the impedance value of the high-frequency test curve profile can be enhanced to be between 75 and 95 ohm by adjusting the widths L4 of the connecting portions 2315, 2325. Thus, the impedance of the plug terminals 23 is adjustable to allow the plug terminals 23 performing good high-frequency characteristics.

Figure 10:
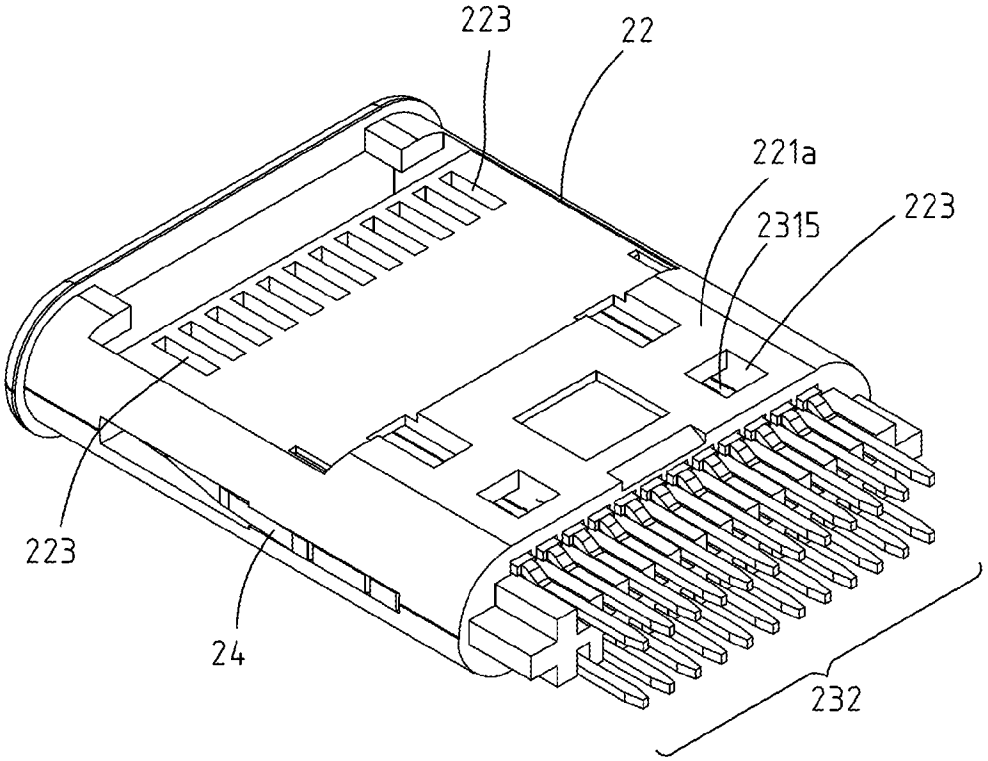
FIG. 10 is a perspective view showing a plurality of plug material cutout slots of the electrical plug connector according to the instant disclosure.

Refer to FIG. 8 and FIG. 10, illustrating one embodiment of the electrical plug connector 200 further comprises a plurality of grooves or through holes 223, and FIG. 10 is a perspective view showing the regions of the insulated housing 22 corresponding to the terminal slots for receiving the plug terminals 23 form grooves or through holes 223 to expose the parts of the plug terminals 23 to air. The insulated housing 22 further defines the grooves or through holes 223 at the upper portion 221*a* and the lower portion 221*b*. In this embodiment, the plug terminals 23 are embedded in the insulated housing 22, and portions of the insulated housing 22 corresponding to the connecting portions 2315, 2325 are partially removed to form recesses, named the grooves or through holes 223, so that parts of the connecting portions 2315, 2325 are exposed to air from the opening of the grooves or through holes 223. Alternatively, the portions of the insulated housing 22 corresponding to the connecting portions 2315, 2325 are completely removed to form through holes, named the grooves or through holes 223, so that parts of the connecting portions 2315, 2325 are exposed to air from the grooves or through holes 223. The grooves or through holes 223 are mainly corresponding to the upper-row elastic contact portions 2314 of the upper-row plug terminals 231 and the lower-row elastic contact portions 2324 of the lower-row plug terminals 232 to allow the upper-row elastic contact portions 2314 and the lower-row elastic contact portions 2324 to be exposed to air from the grooves or through holes 223, respectively. Alternatively, the grooves or through holes 223 may be corresponding to the upper-row connecting portions 2315 and the lower-row connecting portions 2325 to allow the upper-row connecting portions 2315 and the lower-row connecting portions 2325 to be exposed to air from the grooves or through holes 223, respectively. That is, the grooves or through holes 223 are defined at the positions corresponding to the upper-row elastic contact portions 2314 and the lower-row elastic contact portions 2324 of the USB 3.0 transmission signal pairs of the upper-row plug terminal 231 and the lower-row plug terminals 232, or are defined at the positions corresponding to the upper-row connecting portions 2315 and the lower-row connecting portions 2325, but are not defined at the positions corresponding to the USB 2.0 transmission signal pairs of the upper-row plug terminals 231 and the lower-row plug terminals 232. The permittivities of the components of the electrical plug connector 200 affect the high-frequency characteristics of the electrical plug connector 200. In this embodiment, the USB 3.0 transmission signal pairs are exposed to air through the grooves or through holes 223, thereby making the USB 3.0 transmission signal pairs be exposed to air. Since the permittivity of the air is lower than that of the insulated housing 22, when the USB 3.0 transmission signal pairs are not in contact with the insulated housing 22, the plug terminals 23 perform good high-frequency characteristics. In addition, the larger the material removal area of the grooves or through holes 223 is, the larger the area of the USB 3.0 transmission signal pairs to be exposed to air is. Consequently, the plug terminals 23 further perform good high-frequency characteristics. After the high-frequency test is applied to the plug terminals 23, the curve profile of the impedance value of the plug terminals 23 can be adjusted between 75 and 95 ohm according to the number or the material removal area of the grooves or through holes 223.

Figure 12:
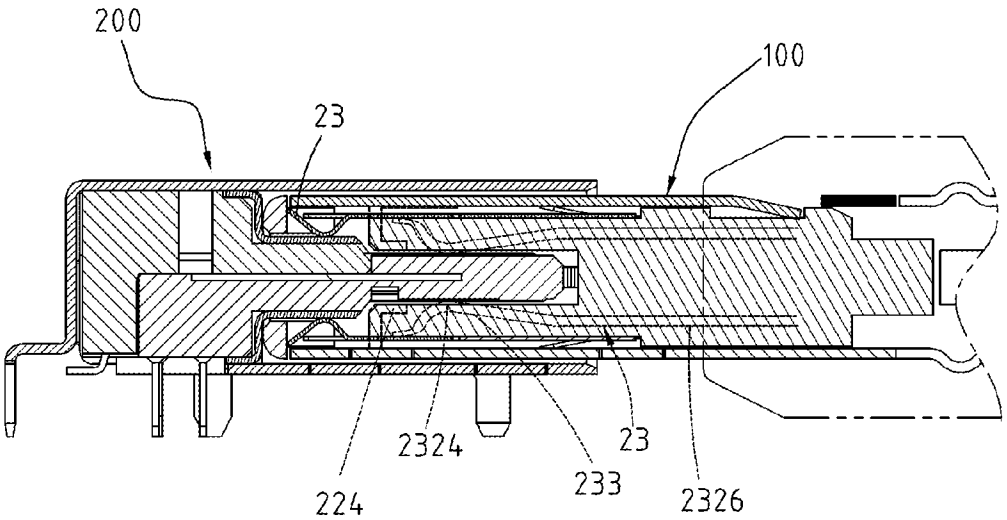
FIG. 12 is a cross-sectional view of the electrical connector assembly according to the instant disclosure.

Referring to FIG. 8, in this embodiment, each of the plug terminals 23 further comprises a plurality of contact surfaces 233 at the corresponding elastic contact portions 2314, 2324. The elastic contact portions 2314, 2324 are arched structures. One of two sides of each of the elastic contact portions 2314, 2324 is a convex surface, and the other side of each of the elastic contact portions 2314, 2324 is a concave surface. The contact surfaces 233 are at the concave surfaces, respectively (as shown in FIG. 12). The plug terminals 23 are arranged densely so as to reduce the overall volume of the electrical plug connector 200. Moreover, when the plug terminals 23 is assembled with the insulated housing 22, through a pre-compression procedure, a compression force is applied to the contact surfaces 233, thereby making the elastic contact portions 2314, 2324 further project into the interior space of the insertion cavity 222. After the pre-compression of the elastic contact portions 2314, 2324, good mechanical properties (for example, elasticity requirements), of the elastic contact portions 2314, 2324 can be performed, thus allowing the elastic contact portions 2314, 2324 perform better elasticity. In addition, the insulated housing 22 further comprises a plurality of blocks 224 at the upper portion 221*a* and the lower portion 221*b*; after the pre-compression of the elastic contact portions 2314, 2324, a front end of each of the elastic contact portions 2314, 2324 can be stopped by the corresponding block 224, thus avoiding the front ends of the elastic contact portions 2314, 2325 from falling into the insertion cavity 222.

Referring to FIG. 9A, as mentioned, the electrical plug connector 200 comprises the power terminals 2312, 2322 (Power/VBUS) and the ground terminals 2313, 2323 (Gnd). The power terminals 2312, 2322 are between the USB 2.0 transmission signal pairs and the USB 3.0 transmission signal pairs, and the ground terminals 2313, 2323 are at two sides of the USB 3.0 transmission signal pairs. From a top view of the plug terminals 23, on the far left is the first ground terminals 2313, 2323, and then sequentially the first group of USB 3.0 transmission signal pairs, the first power terminals 2312, 2322, two pairs of USB 2.0 transmission signal pairs, the second power terminals 2312, 2322, the second group of USB 3.0 transmission signal pairs and the second ground terminals 2313, 2323.

Figure 11:
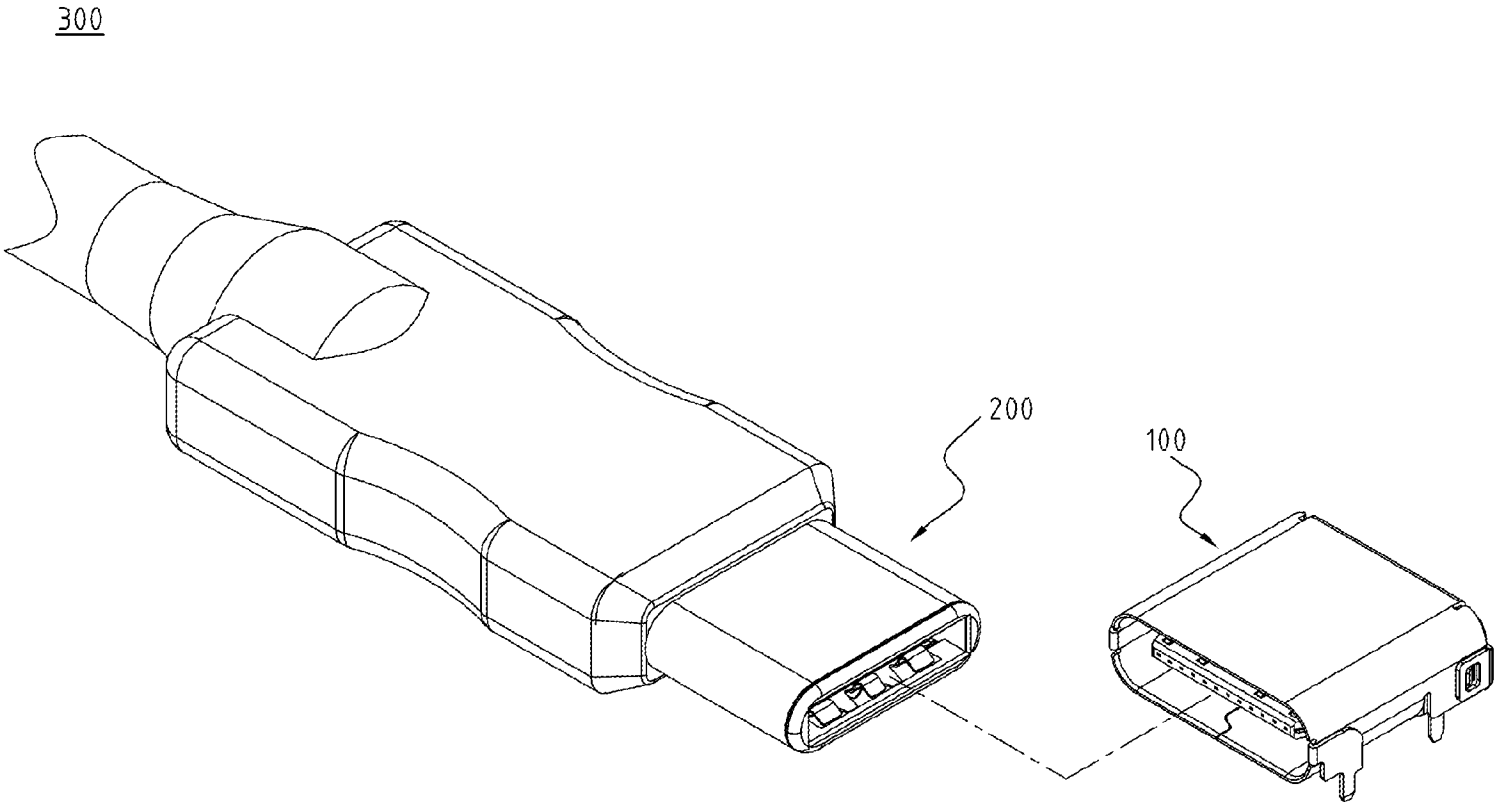
FIG. 11 is an exploded view of an electrical connector assembly according to the instant disclosure.

Refer to FIGS. 11 and 12, which illustrate an embodiment of an electrical connector assembly 300 according to the instant disclosure, FIG. 11 is an exploded view of an electrical connector assembly according to the instant disclosure, and FIG. 12 is a cross-sectional view of the electrical connector assembly according to the instant disclosure. In this embodiment, the electrical connector assembly 300 comprises the electrical receptacle connector 100 in the foregoing embodiment and the electrical plug connector 200 in the foregoing embodiment for being fittingly plugged into the electrical receptacle connector 100, but is not limited thereto. In some embodiments, the electrical connector assembly 300 may comprise the electrical receptacle connector 100 in the foregoing embodiment and an electrical plug connector 200 not in the foregoing embodiment. The difference between the electrical plug connector 200 not in the foregoing embodiment and the electrical plug connector 200 in the foregoing embodiment lies in that, for an electrical plug connector not in the forgoing embodiment, even if the width L4 of the connecting portions is equal to the width L3 of the elastic contact portions, the width L2 of the connecting portions 1315, 1325 of each of the receptacle terminals 13 of the electrical receptacle connector 100 can be changed to be less than or greater than the width L1 of the corresponding flat contact portions 1314, 1324, so that the impedance value of the receptacle terminals 13 can be adjusted to be within a predefined range, thus the receptacle terminals 13 performing good high-frequency characteristics; in this circumstance, the high-frequency characteristics can be performed normally even when the width L4 of the connecting portions is equal to the width L3 of the elastic contact portions for an electrical plug connector not in the forgoing embodiment.

Please Refer to FIG. 8, FIGS. 8A and 10, in this embodiment, the electrical plug connector 200 further comprises two latch arms 24 disposed at two sides of the insulated housing 22, the latch arms 24 is extended inwardly to the insertion cavity 222. The latch arms 23 contact the metal shell 11 of the electrical receptacle connector 100 while the electrical plug connector 200 is inserted into the electrical receptacle connector 100.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell defining a receptacle cavity;

an insulated housing received in the receptacle cavity, wherein the insulated housing comprises a base portion and a tongue portion, the tongue portion is extended from the base portion, and the tongue portion defines an upper surface and a lower surface which are the opposite surfaces of the tongue portion;

a plurality of upper-row receptacle terminals comprising a plurality of upper-row signal terminals, at least one upper-row power terminal, and at least one upper-row ground terminal, wherein each of the upper-row receptacle terminals is held in the base portion and disposed at the upper surface of the tongue portion;

a plurality of lower-row receptacle terminals comprising a plurality of lower-row signal terminals, at least one lower-row power terminal and at least one lower-row ground terminal, wherein each of the lower-row receptacle terminals is held in the base portion and disposed at the lower surface of the tongue portion; and a grounding plate embedded inside the tongue portion, located between the upper-row receptacle terminals and the lower-row receptacle terminals, and comprising a body portion and a plurality of recessed portions, wherein two sides of the body portion are protruded out of side surfaces of the tongue portion;

wherein each of the receptacle terminals comprises:

a connecting portion;

a flat contact portion extended from one of two ends of the connecting portion, disposed at the tongue portion, and corresponding to one of the recessed portions; and a soldering portion extended from the other end of the connection portion and exposed out of the base portion;

wherein the width of the connecting portion is different from the width of the flat contact portion, and the upper-row receptacle terminals and the lower-row receptacle terminals have 180 degree symmetrical design with respect to a central point of the receptacle cavity as the symmetrical center.

2. The electrical receptacle connector according to claim 1, wherein the insulated housing defines a plurality of grooves or through holes at the tongue portion and parts of the connecting portions are exposed to air through the grooves or through holes.

3. An electrical plug connector, comprising:

a metallic shell defining a receiving cavity;

an insulated housing received in the receiving cavity, wherein the insulated housing comprises an upper portion and a lower portion, and defines an insertion cavity, wherein the insertion cavity is between the upper portion and the lower portion;

a plurality of upper-row plug terminals comprising a plurality of upper-row signal terminals, at least one upper-row power terminal, and at least one upper-row ground terminal, wherein each of the upper-row plug terminals is held in the upper portion of the insulated housing and disposed at a lower surface of the upper portion;

a plurality of lower-row plug terminals comprising a plurality of lower-row signal terminals, at least one lower-row power terminal, and at least one lower-row ground terminal, wherein each of the lower-row plug terminals is held in the lower portion of the insulated housing and disposed at an upper surface of the lower portion; and two latch arms respectively disposed at two sides of the insulated housing, wherein each of the latch arms extends inwardly into the insertion cavity for contacting a metal shell of an electrical receptacle connector;

wherein each of the plug terminals comprises:

a connecting portion held in the insulated housing;

an elastic contact portion extended from one of two ends of the connecting portion and projected into the insertion cavity; and a soldering portion extended from the other end of the connecting portion and exposed out of the insulated housing;

wherein the width of the connecting portion is different from the width of the elastic contact portion.

4. The electrical plug connector according to claim 3, wherein the insulated housing defines a plurality of grooves or through holes at an upper surface of the upper portion or a lower surface of the lower portion, and parts of the connecting portions are exposed to air through the grooves or through holes.

5. The electrical plug connector according claim 3, wherein the upper-row plug terminals and the lower-row plug terminals have 180 degree symmetrical design with respect to a central point of the receptacle cavity as the symmetrical center.

6. An electrical receptacle connector, comprising:

a metallic shell defining a receptacle cavity;

an insulated housing received in the receptacle cavity, wherein the insulated housing comprises a base portion and a tongue portion, the tongue portion is extended from the base portion, the tongue portion defines an upper surface and a lower surface which are opposite surfaces of the tongue portion;

a plurality of upper-row receptacle terminals comprising a plurality of upper-row signal terminals, at least one upper-row power terminal, and at least one upper-row ground terminal, wherein each of the upper-row receptacle terminals is held in the base portion and disposed at the upper surface of the tongue portion;

at least one conductive strip disposed at a corner between a bottom side and a front side of a base portion of the insulated housing and contacting an inner wall of the metallic shell; and a plurality of lower-row receptacle terminals comprising a plurality of lower-row signal terminals, at least one lower-row power terminal, and at least one lower-row ground terminal, wherein each of the lower-row receptacle terminals is held in the base portion and disposed at the lower surface of the tongue portion;

wherein the insulated housing defines a plurality of grooves or through holes at the tongue portion and parts of the connecting portions are exposed to air through the grooves or through holes.

7. The electrical receptacle connector according to claim 6, wherein each of the upper-row receptacle terminals comprises:

a connecting portion held in the insulated housing;

a flat contact portion extended from one of two ends of the connecting portion and disposed at the tongue portion; and a soldering portion extended from the other end of the connecting portion and exposed out of the base portion;

wherein the width of the connecting portion is different from the width of the flat contact portion.

8. The electrical receptacle connector according to claim 6, further comprising a grounding plate embedded inside the tongue portion, wherein the grounding plate defines a plurality of recessed portions corresponding to the flat contact portions.

9. The electrical receptacle connector according to claim 6, wherein the upper-row receptacle terminals and the lower-row receptacle terminals have 180 degree symmetrical design with respect to a central point of the receptacle cavity as the symmetrical center.

10. An electrical plug connector, comprising:

a metallic shell defining a receiving cavity;

an insulated housing received in the receiving cavity, wherein the insulated housing comprises an upper portion and a lower portion, and defines an insertion cavity, wherein the insertion cavity is between the upper portion and the lower portion;

a plurality of upper-row plug terminals comprising a plurality of upper-row signal terminals, at least one upper-row power terminal, and at least one upper-row ground terminal, wherein each of the upper-row plug terminals is held in the insulated housing and disposed at a lower surface of the upper portion;

a plurality of lower-row plug terminals comprising a plurality of lower-row signal terminals, at least one lower-row power terminal, and at least one lower-row ground terminal, wherein each of the lower-row plug terminals is held in the insulated housing and disposed at an upper surface of the lower portion; and two latch arms respectively disposed at two sides of the insulated housing, wherein each of the latch arms extends inwardly into the insertion cavity for contacting a metal shell of an electrical receptacle connector;

wherein the insulated housing defines a plurality of grooves or through holes at an upper surface of the upper portion or a lower surface of the lower portion, and parts of the connecting portions are exposed to air through the grooves or through holes.

11. The electrical plug connector according to claim 10, wherein the width of the connecting portion is different from the width of the elastic contact portion.

12. The electrical plug connector according to claim 10, wherein each of the plug terminals comprises:

a connecting portion held in the insulated housing;

an elastic contact portion extended from one of two ends of the connecting portion and projected into the insertion cavity; and a soldering portion extended from the other end of the connecting portion and exposed out of the insulated housing.

13. The electrical plug connector according to claim 10, wherein the upper-row plug terminals and the lower-row plug terminals have 180 degree symmetrical design with respect to a central point of the receptacle cavity as the symmetrical center.

14. The electrical receptacle connector according to claim 1, further at least one conductive strip, wherein the conductive strip is disposed at the corner between the bottom side and the front side of a base portion of the insulated housing and is connected to an inner wall of the metallic shell.

15. The electrical receptacle connector according to claim 1, wherein the grounding plate further comprises two projecting engaging portions, wherein the projecting engaging portions are disposed at the two sides of the body portion and near a front surface of the tongue portion and protruded out of side surfaces of the tongue portion.

16. The electrical receptacle connector according to claim 1, wherein the upper-row receptacle terminals comprises a plurality of upper-row signal terminals, at least one upper-row power terminal, and at least one upper-row ground terminal and the lower-row receptacle terminals comprises a plurality of lower-row signal terminals, at least one lower-row power terminal and at least one lower-row ground terminal.

17. The electrical receptacle connector according to claim 1, wherein the grounding plate further comprises two side pins, and a plurality of rear pins, wherein the recessed portions of the grounding plate are defined at the front lateral side of the body portion, the side pins are extended from the sides of body portion and bent downwardly and protruded out of the base portion, and the rear pins are extended from a rear side of body portion and bent downwardly and protruded out of the base portion.

* * * * *